US005769277A

United States Patent [19]

Elliott

[11] Patent Number: 5,769,277

[45] Date of Patent: Jun. 23, 1998

[54] DISPENSING CLOSURE HAVING A FORCE-DIRECTING REMOVABLE SEAL

[75] Inventor: John Elliott, Burlington, Wis.

[73] Assignee: AptarGroup, Inc., Crystal Lake, Ill.

[21] Appl. No.: 678,159

[22] Filed: Jul. 11, 1996

[51] Int. Cl.[6] ..... B67B 5/00

[52] U.S. Cl. ..... 222/153.07; 215/254; 220/258; 220/270

[58] Field of Search ..... 222/153.07, 541.9, 222/556, 545, 568; 215/254, 256; 220/258, 269, 270, 276

[56] References Cited

U.S. PATENT DOCUMENTS

| | | |
|---|---|---|
| Re. 29,850 | 11/1978 | Labarre . |
| 2,705,085 | 3/1955 | Glensky . |
| 2,895,654 | 7/1959 | Rieke . |
| 3,135,441 | 6/1964 | Wise et al. . |
| 3,160,327 | 12/1964 | Porcelli . |
| 3,207,375 | 9/1965 | Bereziat et al. . |
| 3,223,298 | 12/1965 | Roberson et al. . |
| 3,239,112 | 3/1966 | Porcelli . |
| 3,269,617 | 8/1966 | Goth . |
| 3,278,089 | 10/1966 | Heekin et al. . |
| 3,282,477 | 11/1966 | Henchert . |
| 3,310,206 | 3/1967 | Littlefield . |
| 3,419,181 | 12/1968 | Stec . |
| 3,434,620 | 3/1969 | Laurizio . |
| 3,458,080 | 7/1969 | Laurizio . |
| 3,459,315 | 8/1969 | Labarre . |
| 3,483,355 | 12/1969 | Murdock . |
| 3,495,746 | 2/1970 | Laurizio . |
| 3,567,061 | 3/1971 | Song . |
| 3,604,585 | 9/1971 | Towns . |
| 3,610,484 | 10/1971 | Matzka . |
| 3,661,306 | 5/1972 | Kuckens . |
| 3,734,333 | 5/1973 | Foss . |
| 3,758,000 | 9/1973 | Mack . |
| 3,817,416 | 6/1974 | Costa . |
| 3,823,841 | 7/1974 | Lovejoy . |

(List continued on next page.)

FOREIGN PATENT DOCUMENTS

| | | |
|---|---|---|
| 553753 | 1/1957 | Belgium . |
| 0 570 276 A1 | 5/1993 | European Pat. Off. . |
| A1 0 570 276 | 11/1993 | European Pat. Off. . |
| 0 442 379 B1 | 1/1995 | European Pat. Off. . |
| 0 778 219 A2 | 11/1997 | European Pat. Off. . |
| 1126495 | 7/1956 | France . |
| 79 06608 | 3/1979 | France . |
| 82 05907 | 4/1982 | France . |
| 27 55 136 | 12/1977 | Germany . |
| 1217145 | 12/1970 | United Kingdom . |
| 2 022 064 | 5/1979 | United Kingdom . |
| 2 041 896 | 1/1980 | United Kingdom . |
| WO 95/28274 | 10/1995 | WIPO . |
| WO96/24483 | 8/1996 | WIPO . |

OTHER PUBLICATIONS

"Multi–Material Injection Saves Time, While Cutting Costs," Modern Plastics, Mar. 19, 1994 (Author: Peter Mapleston).

"Molding Many Parts Into One," Product Design and Development, Dec. 19, 1995, p. 16 (Author: Jay Rosenberg).

*Primary Examiner*—Gregory L. Huson

*Attorney, Agent, or Firm*—Rockey, Milnamow & Katz, Ltd.

[57] ABSTRACT

A closure is provided for a container and includes a base. The base includes a body for mounting to the container, and the body defines a dispensing orifice. A tamper-evident seal initially closes the dispensing orifice. The seal has a removable central portion occluding the orifice and at least a first frangible web defining a closed tear path lying in a plane connecting the seal central portion to a surrounding part of the closure. The seal central portion includes a hollow projection having a base located in the plane with one part of the base closer to the first frangible web than is any other part of the base. An outwardly directed force of sufficient magnitude applied to the projection will produce a tear which extends through the first frangible web at a point on the first frangible web closest to the one part of the projection base. The tear thereafter propagates from that point around the seal central portion so as to separate the seal central portion from the closure and thereby open the seal.

20 Claims, 14 Drawing Sheets

U.S. PATENT DOCUMENTS 3,834,597 9/1974 Guala .
3,860,152 1/1975 Marti .
4,022,357 5/1977 Dwinell .
4,179,044 12/1979 Fitte .
4,294,382 10/1981 Summers et al. .
4,344,545 8/1982 Aschberger .
4,350,261 9/1982 Roth .
4,356,939 11/1982 Fitte .
4,369,888 1/1983 Walter .
4,371,089 2/1983 Barendregt .
4,440,310 4/1984 Heyn .
4,442,949 4/1984 Dwinell et al. .
4,452,382 6/1984 Holdt .
4,453,646 6/1984 Harrild .
4,512,486 4/1985 Kobayashi et al. .
4,513,889 4/1985 Beard ..... 222/153.07
4,523,691 6/1985 Larkin et al. .
4,533,062 8/1985 Krautkramer .
4,568,005 2/1986 Jalovec et al. .
4,682,702 7/1987 Gach .
4,699,290 10/1987 Adams .
4,724,977 2/1988 Cleevely et al. .
4,724,978 2/1988 Cleevely et al. .
4,724,979 2/1988 Cleevely et al. .
4,727,999 3/1988 Gach .
4,746,025 5/1988 Krautkramer .
4,747,498 5/1988 Gach .
4,782,964 11/1988 Poore et al. .
4,795,044 1/1989 Beck .
4,807,769 2/1989 Gach .
4,815,618 3/1989 Gach .
4,817,807 4/1989 Hummer .
4,819,819 4/1989 Robertson, Jr. .
4,869,399 9/1989 Dubach .
4,948,003 8/1990 Munoz .
4,948,015 8/1990 Kawajiri et al. .
5,008,066 4/1991 Mueller .
5,133,486 7/1992 Moore et al. .
5,199,618 4/1993 Reil et al. .
5,439,124 8/1995 Mock .
5,439,143 8/1995 Brown .
5,503,282 4/1996 Montgomery .

DISPENSING CLOSURE HAVING A FORCE-DIRECTING REMOVABLE SEAL

TECHNICAL FIELD

This invention relates to container closures. The invention is more particularly related to a sealed, tamper-indicating, closure, and the closure is especially suitable for use with a squeeze-type container wherein a fluid product can be dispensed from the container through the opened closure when the container is squeezed.

BACKGROUND OF THE INVENTION AND TECHNICAL PROBLEMS POSED BY THE PRIOR ART

Various product packaging designs employ barriers or seals across an opening to the package. Such seals can serve as primary or secondary barriers to contaminant ingress. Such seals may also maintain product freshness. In addition, such seals may provide a tamper-indicating function wherein breaking or removing the seal provides evidence that the package has been opened.

Examples of a closure with an internal tamper-indicating seal are disclosed in U.S. Pat. Nos. Re. 29,850, 5,133,486, 4,948,003, 4,807,769, 4,727,999, 4,682,702, 4,179,044, 3,860,152, 3,661,306, 3,282,477, 3,278,089, 3,269,617, 3,329,112, and 3,207,375. These types of closures include a base for mounting the closure to the container. The base includes a pour spout. The pour spout is initially occluded by a sealing disk or member. The periphery of the sealing disk, or some intermediate portion, defines a reduced cross-sectional thickness of material which functions as a frangible web connecting the sealing disk to a radially outward region of material. An exterior portion of the sealing disk may include a pull tab which is grasped by a user's fingers for ripping the sealing disk out of the pour spout. Some such closure designs also include a hinged lid with an internal collar to telescopically receive the pour spout in sealing engagement when the lid is closed so as to provide a liquid-tight and air-tight system after the sealing disk has been removed.

While closures of the above-discussed type may function generally satisfactorily in applications for which they are intended, some such closures can be difficult to open. For example, in some conventional closures the pull tab lies within, and below the upper end of, a pour spout. It may be somewhat difficult to grasp the pull tab within such a pour spout, especially if the pour spout has a relatively small diameter. Thus, it would be desirable to provide an improved system in which a grasping structure could be initially stored in a recessed position within a spout beneath a closed lid and which could be automatically or manually extended to an elevated position above the spout upon removal of the lid so as to readily facilitate grasping of the pull structure by the user.

When a user attempts to tear the sealing disk from a closure, the user may experience difficulty in initiating the tear. Even if a tear is successfully initiated at some location around the sealing disk, the user may find when subsequently opening another, identical closure that the tear is initiated at a somewhat different location on the periphery of the sealing disk. Consequently, it would be desirable to provide an improved system in which the tearing of the sealing member could be preferentially and readily initiated at a specific location adjacent the sealing member. Preferably, the tear propagation origin location should be substantially the same from closure-to-closure.

It would also be desirable to provide an improved closure with other enhanced features. For example, in some applications it might be desirable to provide a closure which could be produced by multi-shot, multi-material injection molding. Then the sealing member could be molded from one material, and the closure base could advantageously be molded from another material having certain other desirable characteristics (e.g., strength, greater hardness, etc.).

For example, a typical body material may have characteristics that are not compatible with the desired operation of a unitary molded sealing member. That is, some materials that would be useful for an exterior closure body may not have characteristics that accommodate relatively easy tearing for seal removal.

Further, while some materials may have strength or hardness characteristics desirable for a closure body, such materials may not be as compatible with the container product as would be desired.

Also, a strong closure body material might have undesirably high gas permeability characteristics that would reduce the effectiveness of the material as a seal.

Accordingly, it would be desirable to provide an improved tearable seal system for a closure that could accommodate the injection molding of different materials for the body and sealing member. Such an improved closure should preferably include a seal member structure wherein an internal seal portion could be readily opened by the user. Such an improved closure should also advantageously provide a tamper-indicating means for visually indicating that the seal has been opened.

It would also be beneficial if such an improved closure could accommodate the use of a variety of seal materials in conjunction with a variety of different closure body materials.

Also, it would be desirable if such an improved closure could be provided with a design that would accommodate efficient, high quality, large volume manufacturing techniques with a reduced product reject rate.

Further, such an improved closure should advantageously accommodate its use with a variety of conventional containers having a variety of conventional container finishes, such as conventional threaded or snap-fit attachment configurations.

The present invention provides an improved closure which can accommodate designs having the above-discussed benefits and features.

SUMMARY OF THE INVENTION

According to the present invention, an improved closure is provided for an opening to a container interior. The closure includes a tamper-indicating seal which is easily manipulated by the user to open the seal. Preferably, a lid is also provided with an optional re-sealing collar for resealing the opening.

The closure seal, in a preferred form, includes a structure which allows removal of the seal by grasping the structure above the closure top, such as above the upper end of a spout. During shipping and storage, before the closure is first used, an optional feature of the design permits the graspable structure to be recessed in the closure (e.g., within a spout) to more readily accommodate closure of an optional lid.

According to one aspect of the invention, a projection is included as part of the seal and functions, when pulled, to direct forces at a location adjacent a frangible web connecting the seal to a surrounding part of the closure so that a tear is readily initiated at one location on the frangible web.

The improved closure permits one material to be used for the closure body and a different, more easily tearable, material to be used for the closure seal.

The closure includes a body for mounting to a container around the container opening. The body is preferably injection-molded from a first material. The body includes an end that defines a dispensing orifice for communicating with the container opening. A pour spout preferably surrounds the dispensing orifice.

A tamper-evident seal is provided in the body. The seal has a removable central portion occluding the orifice and has at least a first frangible web connecting the seal central portion to a surrounding part of the closure. The frangible web preferably defines a closed tear path lying in a plane.

The seal central portion includes a hollow projection having a base located so that one part of the base is closer to the frangible web than is any other part of the base. A tension force of sufficient magnitude applied to the projection will produce a tear through the web beginning at a point on the web which is closest to the one part of the projection base. The tear will propagate around the seal central portion so as to separate the seal central portion from the closure and thereby open the seal.

Preferably, the seal is injection-molded from a different, more easily tearable material than is used for the closure body. In a preferred embodiment, a multi-shot injection molding process is used to first mold the closure body as a "preform" in a first injection phase in a mold. The preform of the closure body is then automatically transferred to a second, differently shaped cavity in the same mold wherein the second material is injection-molded (over-molded) in a second phase onto and against portions of the closure body to form the seal structure.

A lid can be optionally provided for occluding the dispensing orifice in a closed position over the base body. The lid can be moved away from the closed position to permit the dispensing of the container stored contents out of the orifice. The lid is preferably molded as a unitary part of the closure body.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 12A shows a moved position of a portion of the closure illustrated in phantom;

FIG. 16 shows the moved position of the seal in solid lines and the initial position in phantom with dotted lines;

DESCRIPTION OF THE PREFERRED EMBODIMENTS

Figure 1:
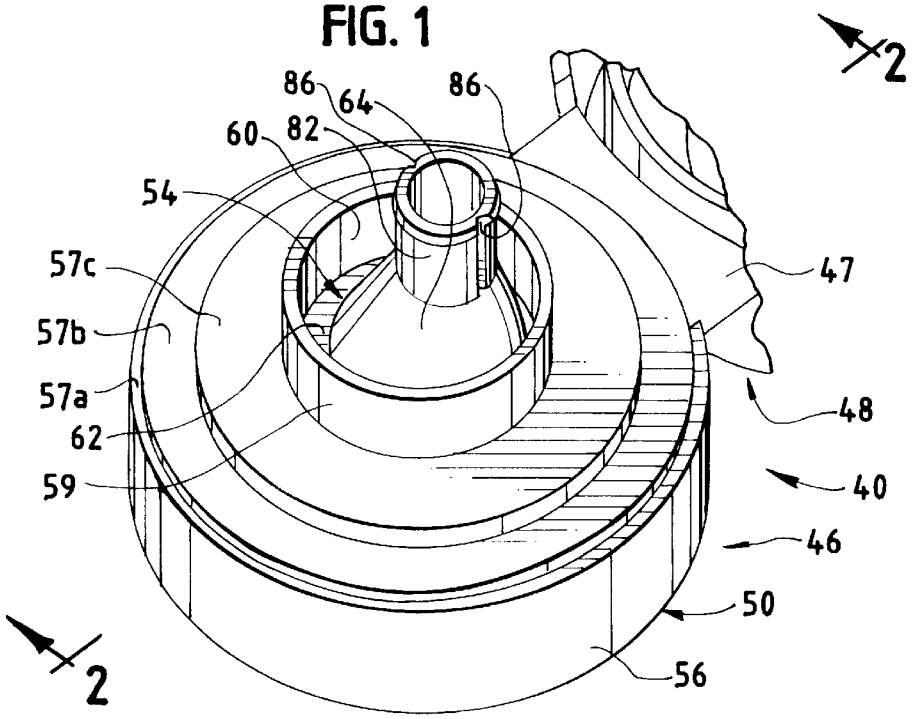
FIG. 1 is a fragmentary, perspective view of a first embodiment of a closure of the present invention shown with the lid open.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure components of this invention are described in various positions, and terms such as upper, lower, horizontal, etc., are used with reference to these positions. It will be understood, however, that the closure components may be manufactured and stored in orientations other than the ones described.

With reference to the figures, a first embodiment of a closure of the present invention is illustrated in FIGS. 1–5 and is represented generally in the figures by reference numeral 40. The closure 40 is adapted to be disposed on a container (not shown) which has a conventional mouth or opening (not visible) formed by a neck or other suitable structure (not shown). The container neck typically has (but need not have) a circular cross-sectional configuration, and the body of the container may have another cross-sectional configuration, such as an oval cross-sectional shape, for example.

The container may typically be a squeezable container having a flexible wall or walls which can be grasped by the user and compressed to increase the internal pressure within the container so as to squeeze the product out of the container through the closure when opened. The container wall typically has sufficient, inherent resiliency so that when the squeezing forces are removed, the container wall returns to its normal, unstressed shape.

The closure 40 includes a base 46. The closure 40 also preferably includes a lid 48 connected to the base 46 with a hinge 47. The base 46 is preferably injection-molded from two different materials, such as thermoplastic materials compatible with the container contents. The base 46 includes a body 50 that is preferably molded from a first material and includes a seal 54 that is preferably molded from a second material (FIG. 2).

Figure 2:
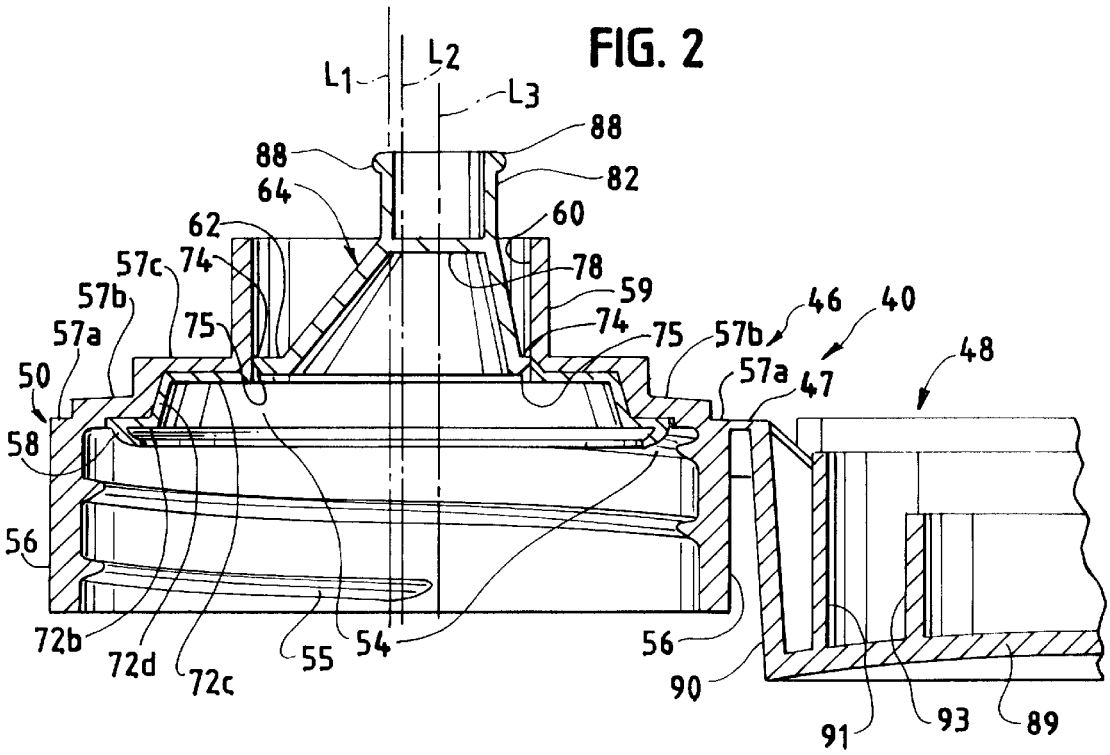
FIG. 2 a cross-sectional view of the closure shown in FIG. 1 taken generally along the plane 2—2 in FIG. 1.

In the first embodiment illustrated in FIGS. 1 and 2, the body 50 includes an annular skirt or wall 56 which may have suitable connecting means (e.g., a conventional thread 55 or conventional snap-fit bead (not illustrated)) for engaging suitable cooperating means, such as a thread or bead on the container neck (not shown) to secure the closure base 46 to the container. The closure base body 50 and container could also be non-releasably connected. For example, they could be welded together by induction melting or ultrasonic melting.

Near the top of the annular wall 56 (as viewed in FIGS. 1 and 2), the closure body 50 has a deck comprising a first, most outwardly, annular shoulder 57*a*, a second, somewhat higher annular shoulder 57*b*, and third, most inwardly, annular shoulder 57*c* which is higher than the shoulder 57*b*. The inner radius of the third shoulder 57*c* terminates in an upwardly extending, annular, tubular spout 59 defining a discharge aperture or dispensing orifice 60 over the container neck opening.

The base seal 54 is a layer or membrane of material which is preferably different than the material from which the body 50 is made. The seal 54 includes a generally central portion occluding the dispensing orifice 60 of the closure base body spout 59. The central portion is defined by a flat region 62 and an upwardly extending projection 64 which includes a hollow frustoconical portion which has the shape of a frustum of a cone.

Outwardly of the flat region 62 the seal 54 includes a peripheral anchor portion comprising outwardly extending, offset, peripheral portions 72*b* and 72*c* (FIG. 2) adjacent the interior surfaces of the deck shoulders 57*b* and 57*c*, respectively. In the embodiment illustrated in FIGS. 1 and 2, the seal 54 extends along the inside surface-of the body 50 so as to define a frusto-conical wall 72*d* connecting the portions 72*b* and 72*c*.

Preferably, an annular, flexible "crab's claw" shaped seal 58 (FIG. 2) projects downwardly from the peripheral portion 72*b* and is received against the upper edge of the container neck (not shown) adjacent the container neck opening so as to provide a leak-tight seal between the closure base 46 and the container neck. Of course, other types of closure base/container seals may be employed as described in detail hereinafter. Also, if air-tightness is not required, no closure base/container seal 58 need be employed.

As best seen in FIG. 2, the tamper-evident seal 54 includes a frangible, reduced thickness web or section 74 of the seal material connecting the periphery of the central portion flat region 62 to the seal peripheral anchor portion. In particular, the web 74 is connected directly to the annular portion 72*c* which is part of the entire peripheral portion that also includes the frustoconical wall 72*d*, the flat annular portion 72*b*, and the crab's claw seal 58. The frangible, reduced thickness section of material or web 74 is defined by an annular notch or groove 75 which opens downwardly around the periphery of the seal central portion (FIG. 2).

The seal central portion projection 64 is hollow and outwardly convex. The preferred shape of the projection 64 is a frustum of a cone defining a bottom base which has a circular configuration and which lies in a plane across the dispensing orifice 60 near the bottom of the spout 59.

The dispensing orifice 60 is preferably circular and defines a longitudinal axis $L_1$. The circular base of the projection 64 defines a longitudinal axis $L_2$. The circular base of the projection 64 is offset relative to the longitudinal axis $L_1$, of the circular dispensing orifice 60 (FIG. 2). In particular, the projection 64, including its circular base and axis $L_2$, is offset toward the right as viewed in FIG. 2 so that one part of the projection circular base is closer to the frangible web 74 than is any other part of the projection base. With reference to FIG. 2, one part of the circular base of the projection 64 is preferably tangent, or substantially tangent, to the frangible web 74 at one point adjacent the spout 59. The remaining portion of the circular base of the projection 64 lies radially inwardly of the circular, frangible web 74.

Figure 3:
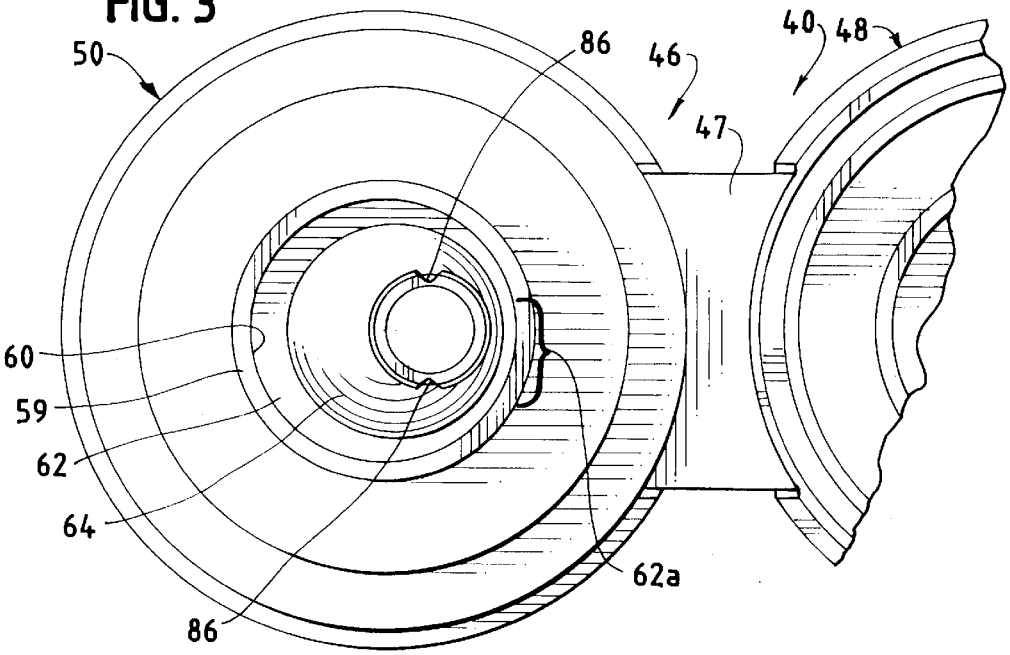
FIG. 3 is a fragmentary, top plan view of the closure shown in FIG. 2.
Figure 4:
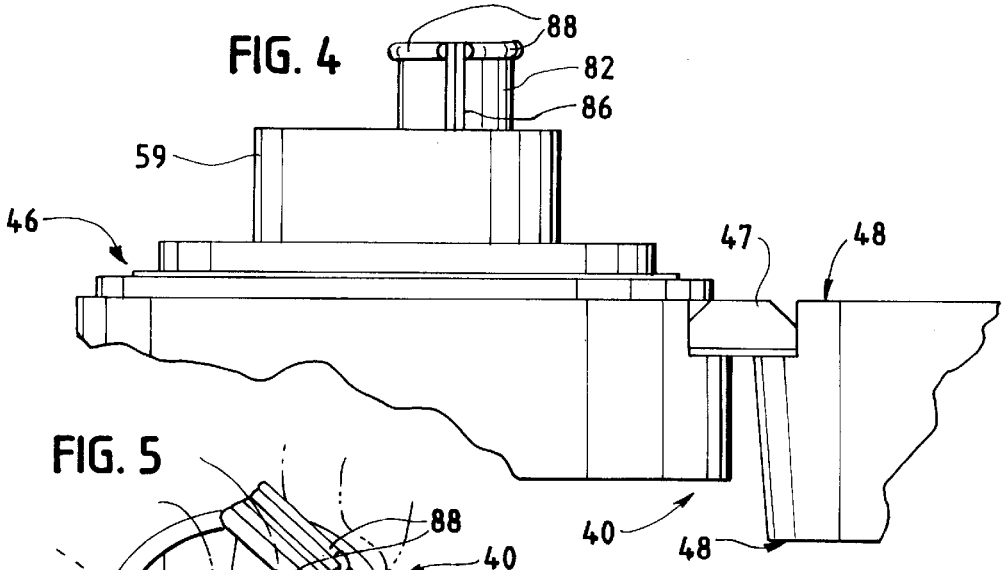
FIG. 4 is a fragmentary, side elevational view of the closure shown in FIG. 3.

Because the circular base of the projection 64 is laterally offset relative to the vertical longitudinal axis $L_1$, of the circular dispensing orifice 60, the width of the flat region 62 around the base of the projection 64 varies as can be seen in FIG. 3. Where the circular base of the projection 64 is closest to the inside surface of the spout 59, there can be a narrow segment or region 62*a* of the flat region 62 which essentially defines the upper surface of the frangible web 74. To the extent that this narrow segment 62*a* is present, the flat region 62 can be regarded as extending completely around the base of the projection 64 so as to include the narrow segment 62*a*. However, to the extent that the closure may be designed so that the narrow segment 62*a* becomes infinitesimally small or is omitted, the remaining flat region 62 adjacent the base of the projection 64 may be characterized as crescent-shaped.

In the preferred embodiment illustrated in FIGS. 1–5, the projection 64 defines a frustum of cone which is oriented so that, when viewed in cross-section in FIG. 2, one side is steeper (more vertical) than the other side. Preferably, as shown in FIG. 2, the steeper side defines the portion of the projection 64 which is closer to the frangible web 74 and spout 59.

The top of the projection 64 includes a unitary circular membrane defining a circular, upper end 78. The circular, upper end 78 of the projection 64 defines a longitudinal axis $L_3$ which is parallel to, but offset from, the longitudinal axis $L_2$ defined by the circular base of the projection 64.

The seal 54 further includes a squeezable hollow, tubular grasping member 82 extending upwardly from the projection circular upper end 78. The member 82 also defines a pair of oppositely oriented, vertical, V-shaped groves 86 (FIGS. 1 and 3). The grooves 86 are preferably located 180 degrees apart. The upper end of the tubular member 82 defines a pair of lips or beads 88. Each lip or bead 88 has a generally semicircular configuration extending between the two grooves 86.

Figure 5:
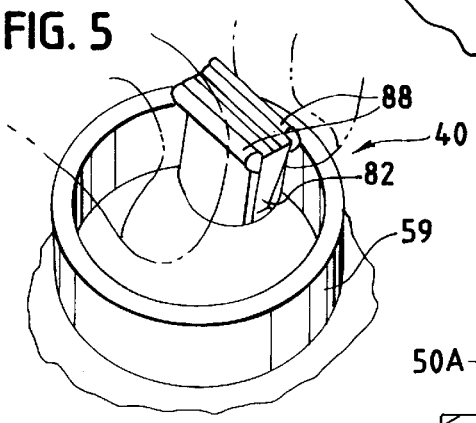
FIG. 5 is a view similar to FIG. 1, but FIG. 5 shows the seal being pulled to open the closure.

The tubular member 82 may be grasped between the thumb and index finger, as illustrated in phantom by dashed lines by FIG. 5, and two opposite sides of the tubular member 82 can then be squeezed together. The vertical grooves 86 effectively reduce the wall thickness of the tubular member 82, and each of the grooves 86 defines an axis about which the semi-cylindrical portions of the tubular member 88 can be deformed and squeezed together (as illustrated in FIG. 5) to present a more easily graspable configuration.

The tubular member 82 functions as a grasping member or pull tab for use in opening the seal 54. To this end, the member 82 is squeezed as shown in FIG. 5, and pulled upwardly. The member 82 may also be pulled somewhat radially outwardly in any direction. Preferably, however, as the member 82 is pulled upwardly, it is also pulled toward the left as viewed in FIG. 2 (i.e., away from the steep side of the projection 64 and toward the less steep side).

The pulling force is transmitted by the member 82 to the projection 64, and this will produce a tear through the frangible web 74. The tear begins at the point on the web 74 which is closest to the base of the projection 64. The tear thereafter propagates from that point in a closed path around the central portion of the seal 54. This separates the seal central portion (containing the flat region 62, projection 64, and member 82) from the rest of the closure so as to open the seal. The torn away central portion of the seal can then be discarded.

Because the projection 64 is axially offset relative to the longitudinal axis $L_1$, of the closure orifice 60 and circular frangible web 74, the forces exerted on the projection 64 (when the member 82 is pulled to open seal) are not evenly distributed. The forces are directed in a way that causes the tear to readily start at the location on the frangible web 74 that is closest to the base of the projection 64. Thus, the seal 54 can be designed to open at that same location in each closure, and the magnitude of the required pulling force to initiate tearing can be maintained in a relatively narrow, predetermined range.

Although the projection 64 is illustrated as a frustum of cone in the preferred embodiment illustrated in FIGS. 1–5, the projection 64 could have other configurations. Further, the base of the projection 64 need not be directly tangent or adjacent to the frangible web 74. However, the projection base must be offset relative to the web 74 so that some portion of the projection base is closer to a part of the frangible web 74 than is any other part of the projection base.

In a preferred embodiment, the closure base body 50 is molded from a first material, such as polypropylene, and the seal 54 is molded from a second material, such as polyethylene. Preferably, a multi-shot injection molding process is used to first mold the closure base body 50 (and lid 48 if unitary with the body 50) as a "preform" in a first injection phase in a mold. The preform of the closure base body 50 is then automatically transferred to a second, differently shaped cavity in the same mold wherein the second material (e.g., polyethylene) is injection-molded (over-molded) in a second phase onto and against portions of the closure base body or preform to form the seal 54. The seal 54 is preferably attached to the closure base body 50 by the creation of a weld defined by the interface solidification of melted portions of the first and second materials. Alternatively, or in addition, the first and second material may be injection-molded so as to define a mechanical interlock of the materials.

Descriptions of multi-shot, multi-material injection molding techniques are set forth in "Multi-Material Injection Saves Time, While Cutting Costs," MODERN PLASTICS, Mar. 19, 1994 (author: Peter Mapleston), in "Molding Many Parts Into One," Product Design and Development, Dec. 19, 1995, page 16 (author: Jay Rosenberg), and in U.S. Pat. No. 5,439,124.

The use of polyethylene for injection molding the seal 54 is advantageous in many applications because polyethylene provides a relatively good oxygen barrier which prevents oxygen migration through the seal into the container. This is especially useful for closures on containers containing food. Additionally, polyethylene provides the desired tear characteristics that accommodate opening of the seal 54 as described in detail hereinafter.

The closure lid 48 may be an entirely separate piece unconnected to the closure base 46. Preferably, a hinge 47 is provided for connecting the lid 48 to the body base 46 to form a unitary structure. The hinge may be a floppy hinge or a snap-action hinge.

As shown in FIG. 2, the lid 48 includes a concave, top wall 89, an outer skirt or wall 90, and an inner wall 91. As illustrated in FIG. 3, the lid outer wall 90 is adapted to seat on the annular shoulder 57*a* defined at the top of the closure base body sidewall 56. The lid inner wall 91 is designed to be located on top of the closure base body annular shoulder 57*b*.

An annular sealing collar 93 extends from the top wall 89. The collar 93 is spaced radially inwardly from the inner wall 91 for sealingly engaging the exterior of the spout 59 when the lid 48 is closed. The lid 48 can be made tall enough to fit over the seal tubular member 82 (or the seal projection 64 and tubular member 82 can be made short enough to fit under the lid 48). Alternatively, a short lid 48 can be designed to push a taller member 82 downwardly somewhat so as to compress or bend the member 82 and/or projection 64 sufficiently to accommodate closure of the lid 48.

When the user desires to dispense product from the container through the closure 40, the user lifts the lid 48 away from the spout 59. When the lid 48 is moved far enough away from the spout 59, the seal 54 may be opened as previously described, and the product may be discharged from the container through the spout 59 by squeezing the container. When it is again desired to close the container, the lid 48 is moved back onto the base 46.

Figure 6:
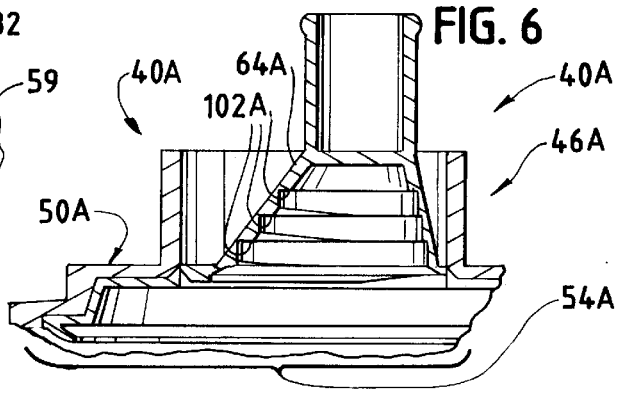
FIG. 6 is a view similar to FIG. 2, but FIG. 6 shows a second embodiment of the closure.
Figure 7:
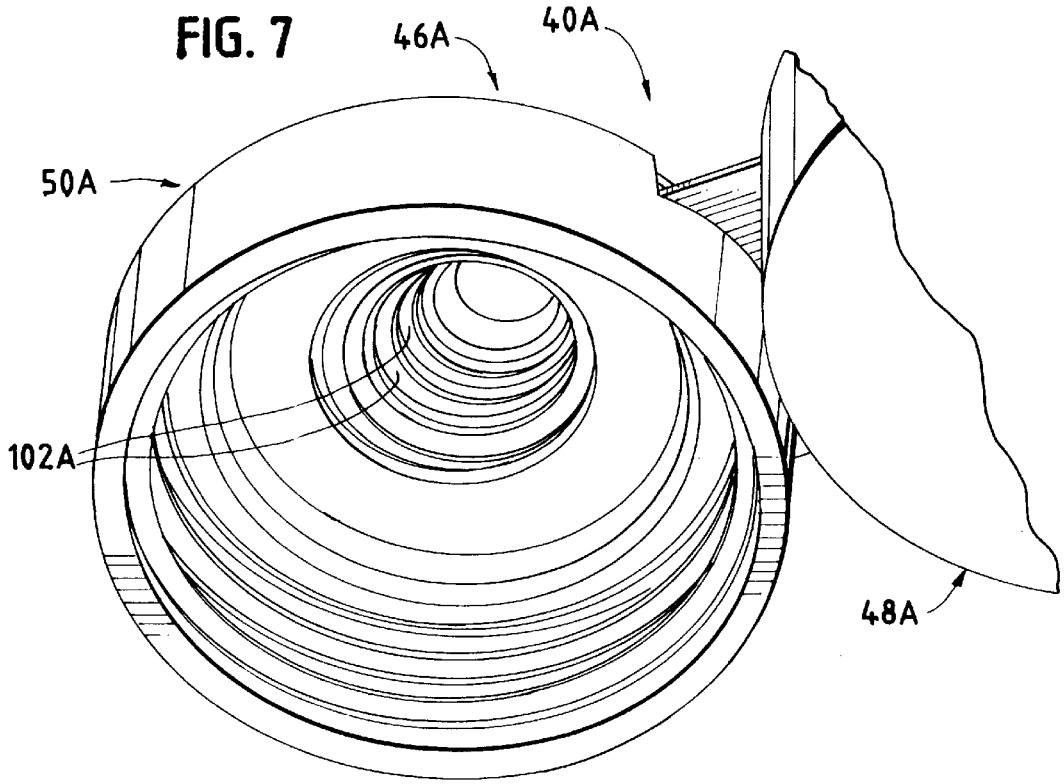
FIG. 7 is a perspective view from the bottom of the second embodiment of the closure shown in FIG. 6.
Figure 8:
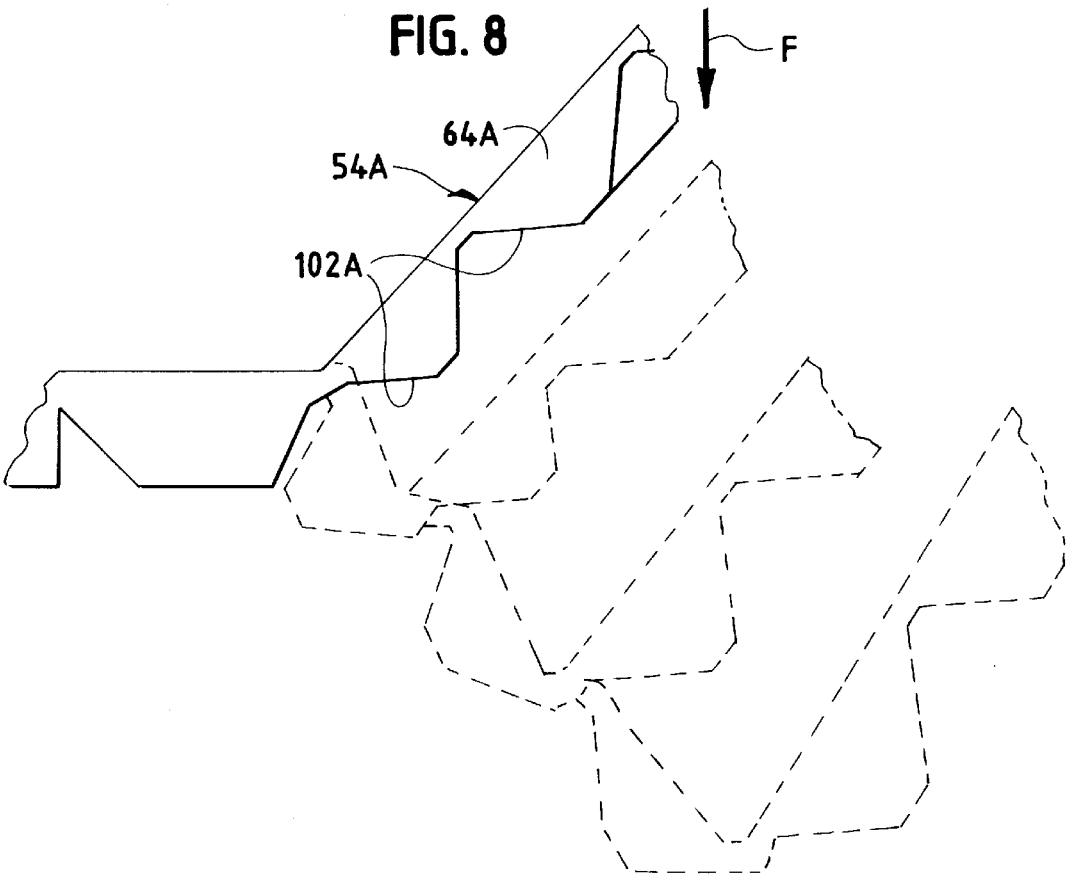
FIG. 8 is a greatly enlarged, fragmentary, cross-sectional view similar to FIG. 6, but FIG. 8 shows moved positions of a portion of the closure with the moved positions illustrated in phantom by dotted lines.
Figure 9:
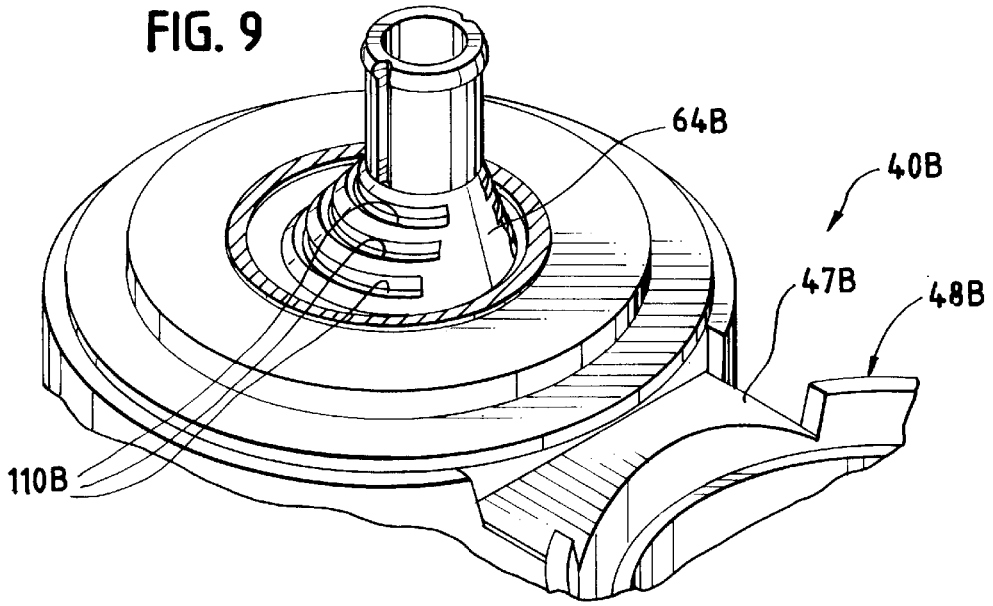
FIG. 9 is a view similar to FIG. 1, but FIG. 9 shows a third embodiment of the closure of the present invention with the spout cut away to reveal interior details.
Figure 10:
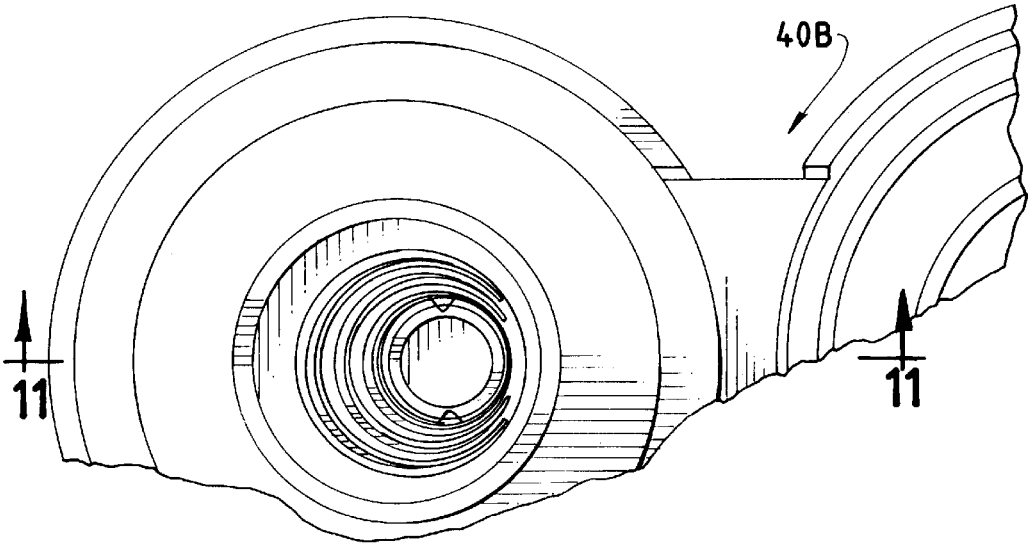
FIG. 10 is a fragmentary, top plan view of the third embodiment of the closure illustrated in FIG. 9.
Figure 11:
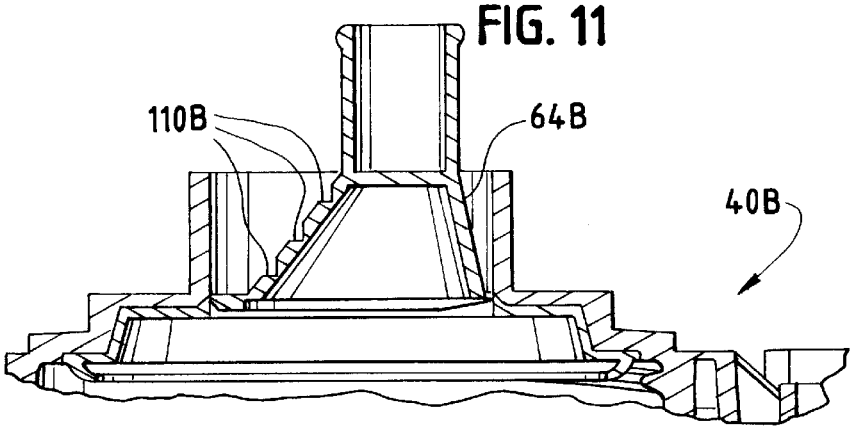
FIG. 11 is a fragmentary, cross-sectional view taken generally along the plane 11—11 in FIG. 10.

FIGS. 6–8 illustrate a second embodiment of the closure 40A. The closure 40A includes a closure base 46A. The base 46A includes a body 50A which is identical with the body 50 of the first embodiment of the closure 40 described above with reference to FIGS. 1 and 2. The second embodiment closure 40A includes a lid 48A which may be identical with the lid 48 described above with reference to FIGS. 1–5 illustrating the first embodiment of the closure 40.

The base 46A of the second embodiment of the closure 40A includes a seal structure 54A. The seal structure 54A is identical with the seal structure 54 described above with reference to the first embodiment illustrated in FIGS. 1–5, except that the second embodiment seal structure 54A also includes a plurality of interior circular bores defining annular shoulders, grooves, or notches 102A in the projection 64A, and the notches 102A define flexible hinges. That is, the shoulders or the notches 102A decrease the wall thickness of the projection 64A and define areas at which the wall of the projection 64A can bend under the influence of a sufficient downward force.

FIG. 8 illustrates in phantom with dashed lines the bending of the wall of the projection 64A as the downward force F is applied. The projection 64A collapses in the downward direction, and this decreases the overall height of the seal 54A. This would more readily accommodate a shorter lid 48A in the closed position. A container with such a closure 40A could be provided by the manufacturer to the consumer with the seal 54A in the downwardly collapsed configuration and with the lid 48A closed. When it is desire to use the closure, the lid 48A is first opened. Then the user pulls the seal 54A upwardly from the collapsed orientation (shown-in phantom in FIG. 8) to the fully extended orientation (FIG. 6). The extended seal 54A is then pulled with greater force, and the central portion of the seal 54A tears away in the same manner as described above for the seal 54 of the first embodiment of the closure 40 illustrated in FIGS. 1–5.

Figure 12:
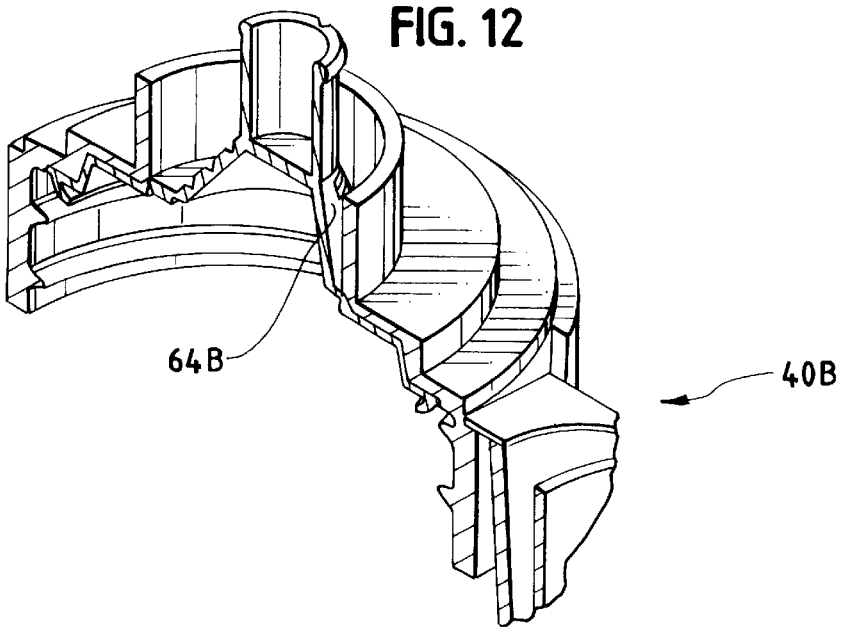
FIG. 12 is similar to FIG. 9, but FIG. 12 shows the near side of the closure cut away to illustrate interior details.
Figure 12A:
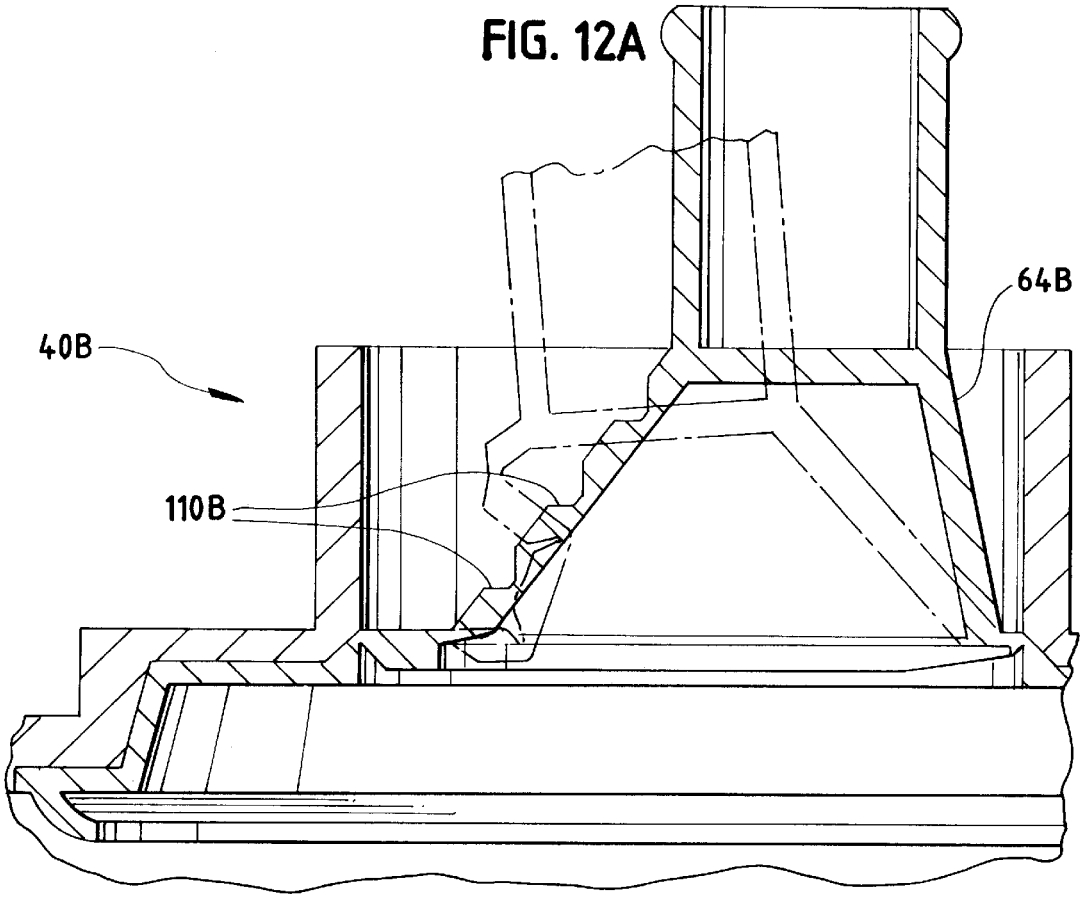
FIG. 12A is a greatly enlarged, fragmentary, cross-sectional view similar to FIG. 11.
Figure 13:
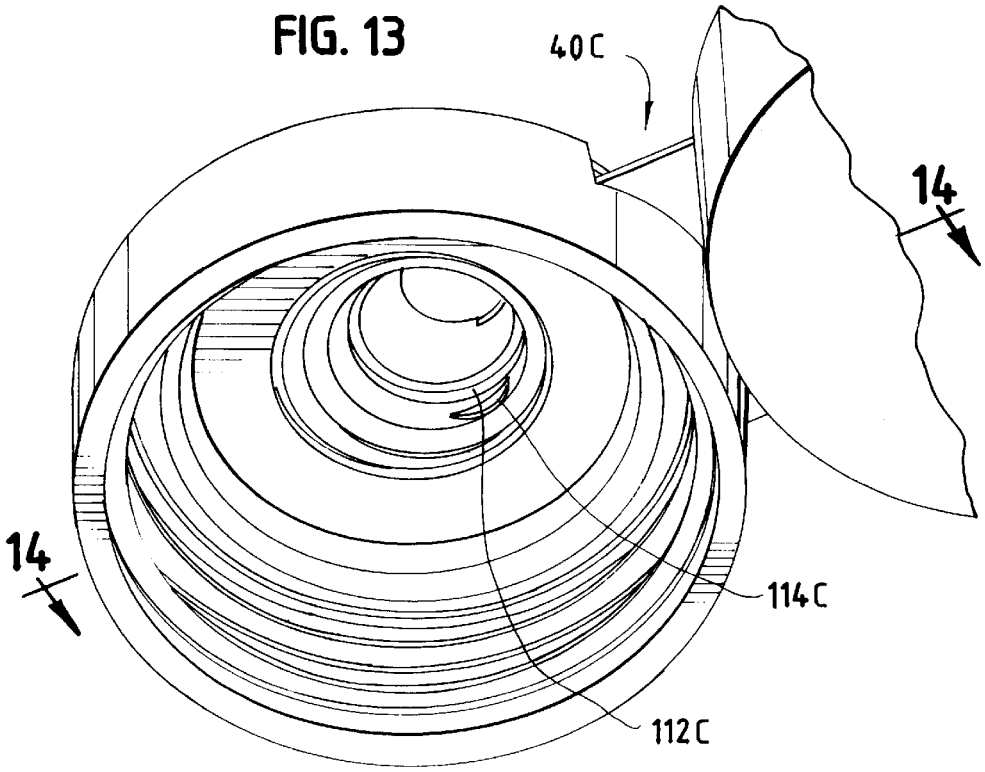
FIG. 13 is a fragmentary, bottom perspective view of the fourth embodiment of the closure of the present invention.
Figure 14:
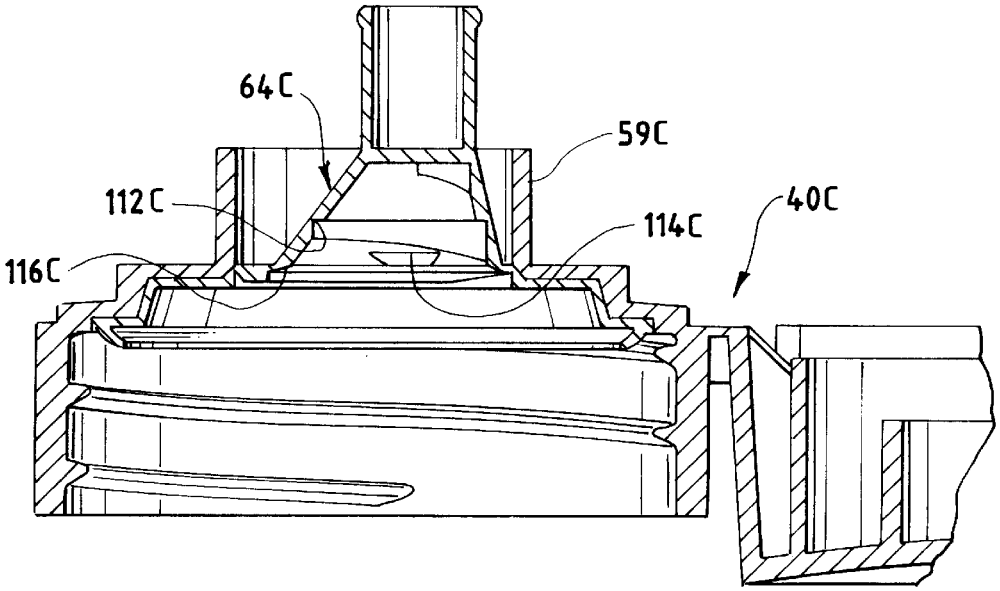
FIG. 14 is a fragmentary, cross-sectional view taken generally along the plane 14—14 in FIG. 13.

FIGS. 9–12 and 12A illustrate a third embodiment of the closure 40B. The closure 40B is similar to the second embodiment of the closure 40A illustrated in FIGS. 6–8, except that the third embodiment of the closure 40B has exterior shoulders, grooves or notches 110B which extend only part way around, and on the exterior surface of, the seal projection 64B. As illustrated in FIG. 12A, the notches 110B define flexible hinges around a major portion of the projection 64B. As shown in FIG. 12A, this accommodates the collapsing of a portion of the projection 64B so as to lower the projection 64B further into the closure spout to accommodate the closing of the lid on the closure. In this embodiment, when the projection 64B is pushed downwardly toward the collapsed orientation (as shown in FIG.12A), the projection 64B tends to lean forwardly (away from the lid 48B and hinge 47B) owing to the fact that the notches 110B do not extend all the way to the rear portion of the projection 64B adjacent the hinge 47B. Typically, each notch 110B extends around the projection 64B in an arc between about 270 degrees and about 355 degrees.

The seal 54B, when it is in the extended configuration, can be torn to open it in the same manner as described above for the second embodiment seal 54A illustrated in FIGS. 6–8.

FIGS. 13–16 illustrate a fourth embodiment of the closure designated generally therein by the reference numeral 40C. The closure 40C includes a seal 54C similar to the seal 54 of the first embodiment illustrated in FIGS. 1–5, except that the fourth embodiment seal 54C has a projection 64C which further includes (1) an internal annular groove, notch, or shoulder 112C, (2) a pair of opposed, internal notches or flats 114C below the annular shoulder 112C, and (3) an internal, arcuate recess or notch 116C along a portion of the base of the projection 64C. For ease of illustration, FIGS. 15 and 16 omit the surrounding closure body and show only the seal 54C.

Figure 15:
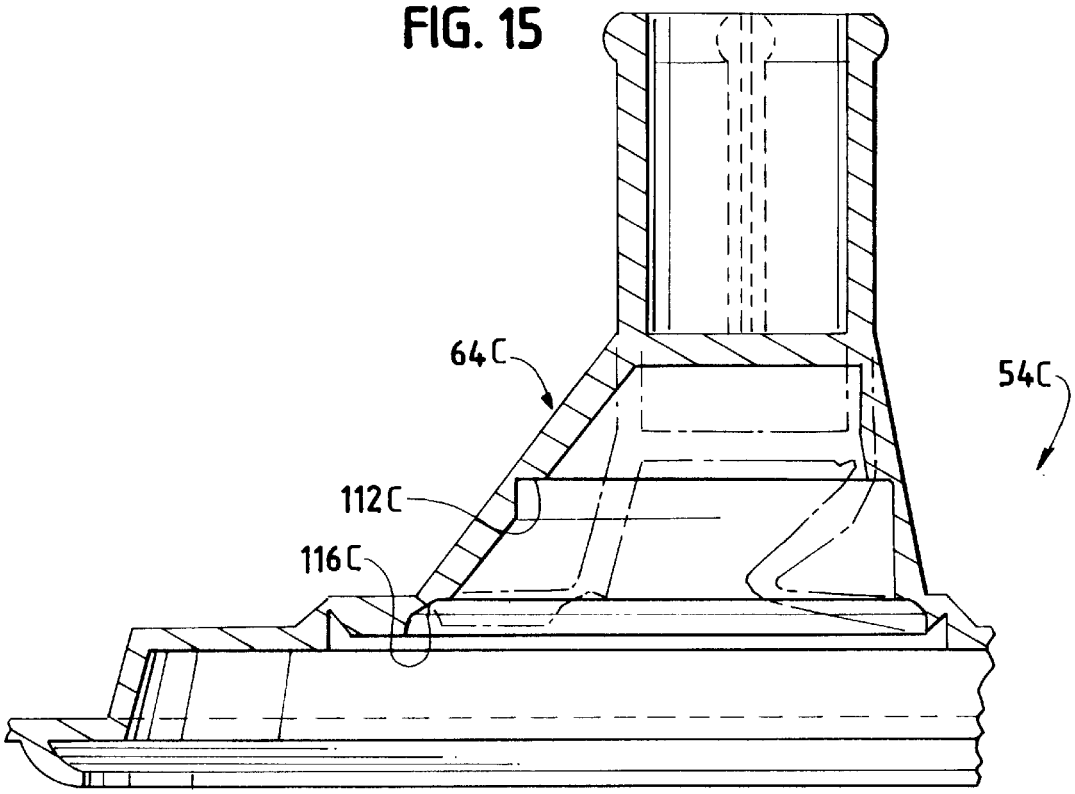
FIG. 15 is view similar to FIG. 14, but FIG. 15 omits the closure body and illustrates only the seal in a moved position in phantom with dotted lines.
Figure 16:
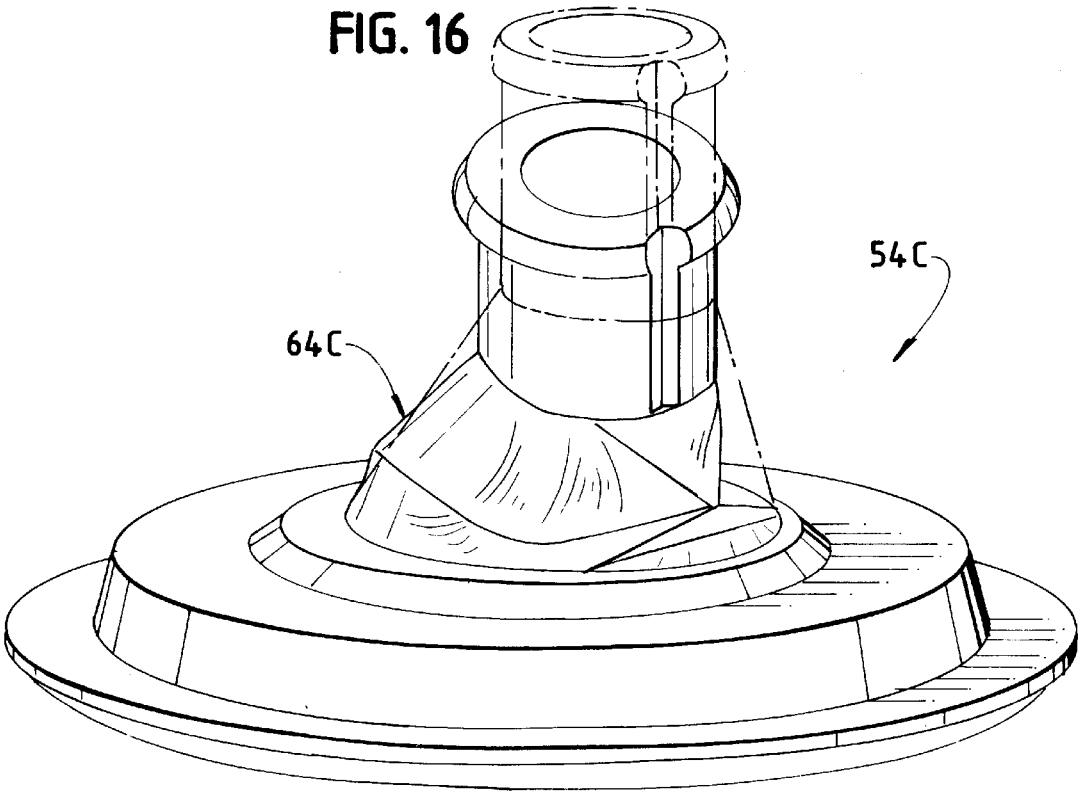
FIG. 16 is a perspective view of the seal illustrated in FIG. 15.

The notches or flats 114C, the annular shoulder 112C, and the arcuate notch 116C all define reduced thickness wall sections in the projection 64C. This accommodates bending of portions of the wall of the projection 64C when the projection 64C is subjected to a downward force. A moved, partially lowered position of the projection 64C is illustrated in phantom lines in FIG. 15 and in solid lines in FIG. 16. With reference to FIG. 15, the right-hand side of the projection 64C buckles or bends inwardly, and the left-hand side of the projection 64C also buckles inwardly. With reference to FIG. 16, the sides of the projection 64C buckle inwardly at the flats 114C (which are not visible in the exterior view depicted in FIG. 16).

The inward buckling of portions of the closure seal projection 64C results in a reduction of the overall height of the seal 54C. This accommodates an initial storage of the lowered seal 54C in a spout 59C (FIG. 14) of the closure to permit the use of a shorter spout and/or to facilitate closing of a short lid.

When it is desired to first open the closure seal 54C, the retracted or collapsed seal 54C can be pulled upwardly. Then the seal 54C can be torn away in the same manner as described above for the seal 54 of the first embodiment of the closure 40 illustrated in FIGS. 1–5.

Figure 17:
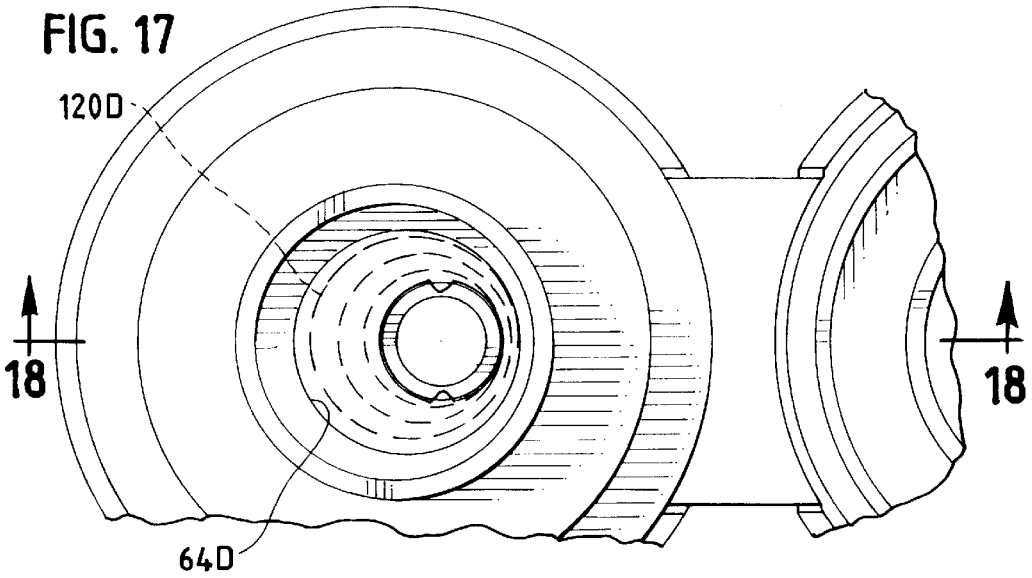
FIG. 17 is a fragmentary, top plan view of a fifth embodiment of the closure of the present invention.
Figure 18:
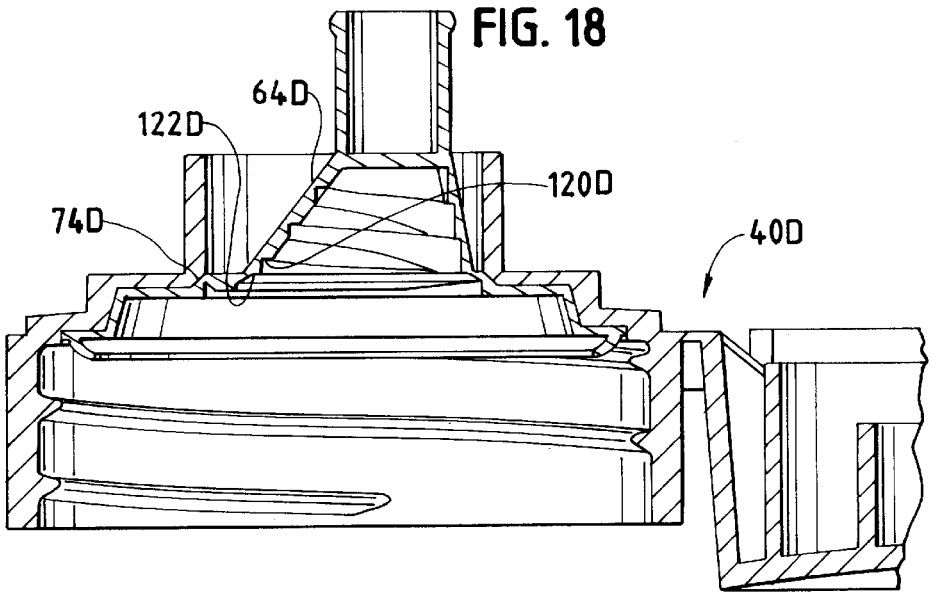
FIG. 18 is a fragmentary, cross-sectional view taken generally along the plane 18—18 in FIG. 17.

FIGS. 17 and 18 illustrate a fifth embodiment of the closure designated generally therein by the reference numeral 40D. The fifth embodiment of the closure 40D includes a projection 64D which has an internal, helical groove 120D. Around the inside of the base of the projection 64D there is a thin wall section 122D which can flex or bend to provide a hinge action. The helical groove 120D extends down the projection 64D and then outwardly to a frangible web 74D which has a structure identical to the web 74 described above with reference to the first embodiment illustrated in FIGS. 1–5.

When a downward force is applied to the top of the projection 64D, the projection 64D will flex along section 122D and along the weakened wall portions defined by the helical groove 120D. This will cause collapse of the projection 64D. In the collapsed position, the wall of the projection 64D buckles and bends downwardly in a manner similar to that illustrated for the second embodiment shown in FIG. 8. This will lower the overall height for initial delivery to the user.

The user may subsequently extend the collapsed projection 64D. The extended projection 64D may then be torn away as described above with reference to the first embodiment projection 64 illustrated in FIGS. 1–5.

Figure 19:
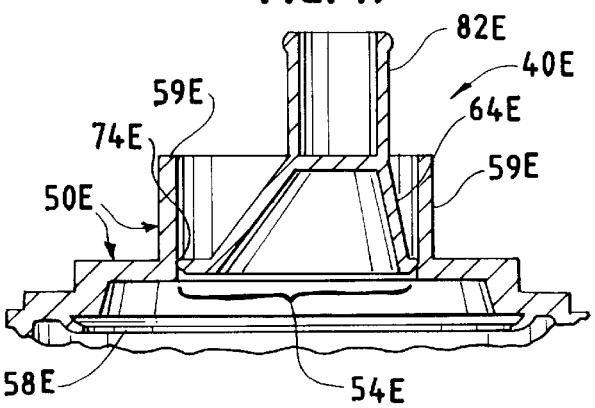
FIG. 19 is fragmentary, cross-sectional view of a sixth embodiment of the closure of the present invention.

FIG. 19 illustrates a sixth embodiment of a closure 40E. The closure 40E is similar to the first embodiment of the closure 40 illustrated in FIGS. 1–5 except that the sixth embodiment closure 40E is molded as one piece. That is, a seal 54E is molded as a unitary part of the closure body 50E. The closure 40E is molded with a frangible web 74E connecting the periphery of the seal 54E to the inside cylindrical surface of a spout 59E defined by the closure body 50E. The seal 54E includes a projection 64E and tubular member 82E which are substantially identical to the projection 64 and tubular member 82, respectively, of the first embodiment closure 40 described above with reference to FIGS. 1–5.

Figure 20:
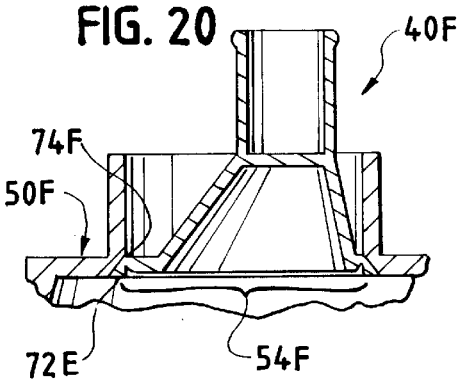
FIG. 20 is a fragmentary, cross-sectional view of a seventh embodiment of the closure of the present invention.

FIG. 20 illustrates a seventh embodiment of the closure of the present invention designated generally by the reference number 40F. The closure 40F includes a body 50F in which is mounted a seal 54F. The seal 54F is similar to the seal 54 of the first embodiment of the closure 40 described above with reference to FIGS. 1–5 except that the seventh embodiment seal 54F does not include all the peripheral portions employed in the first embodiment, such as portions 72*b*, 72*c*, 72*d* illustrated in FIG. 2. Rather, the seventh embodiment seal 54F has only a very small peripheral, anchor portion 72*e* which is molded against, and attached to, the closure body 50F. The annular anchor portion 72*e* is connected via a frangible web 74E to the central portion of the seal 54F.

Figure 21:
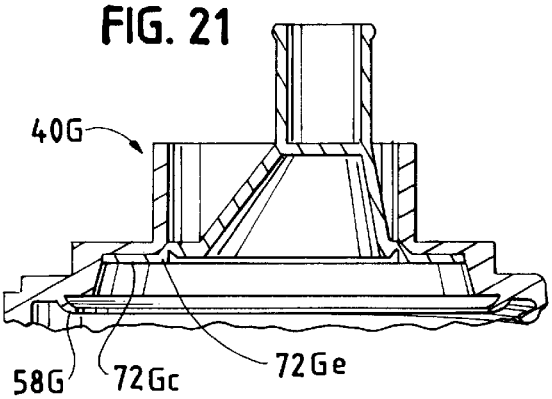
FIG. 21 is a fragmentary, cross-sectional view of an eighth embodiment of the closure of the present invention.

FIG. 21 illustrates an eighth embodiment of the closure designated generally by the reference number 40G. The closure 40G is similar to the seventh embodiment of the closure 40F described above with reference FIG. 20 except that the eighth embodiment of the closure 40G includes an additional annular anchor portion 72G*c* extending outwardly from a small, annular anchor portion 72G*e*.

The sixth, seventh, and eighth embodiments illustrated in FIGS. 19, 20, and 21, respectively, each include an annular, flexible, crab's claw type seal as a unitary part of the closure body for sealing against the upper end of the container neck—such a seal being designated by reference number 58E in FIG. 19 and 58G in FIG. 21. Such container neck seals function in a manner similar to the manner in which the container neck seal 58 functions in the first embodiment of the closure 40 described above with reference to FIG. 2.

Figure 22:
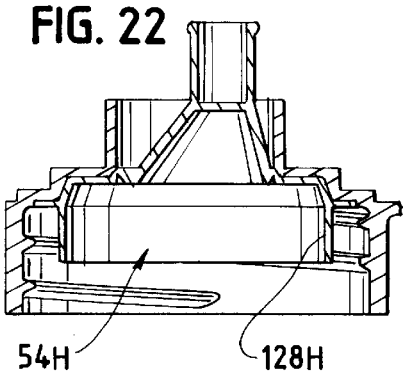
FIG. 22 is a fragmentary, cross-sectional view of a ninth embodiment of the closure of the present invention.
Figure 23:
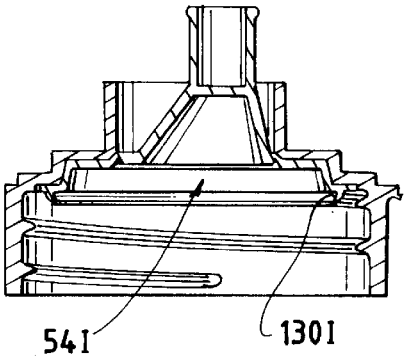
FIG. 23 is a fragmentary, cross-sectional view of a tenth embodiment of the closure of the present invention.
Figure 24:
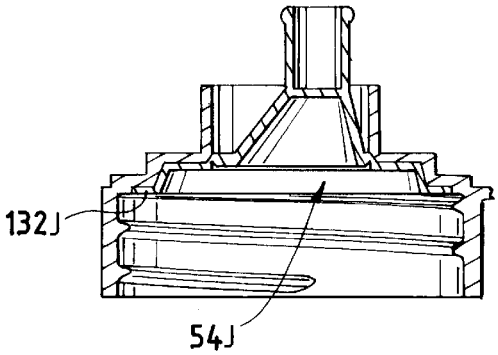
FIG. 24 is fragmentary, cross-sectional view of an eleventh embodiment of the closure of the present invention.

FIGS. 22–24 illustrate other embodiments in which the seal for engaging the upper end of the container neck is provided as a unitary part of a tamper-evident seal that is molded across the closure body from a material which is different than the closure body material. FIG. 22 illustrates a closure with a tamper-evident seal 54H having a container neck plug seal 128H. FIG. 23 illustrates a closure with a tamper-evident seal 54I having a container neck V-seal 130I which has a V-shaped cross section. FIG. 24 illustrates a closure having a tamper-evident seal 54J with a container neck flat seal 132J.

The tamper-evident seals may be separately molded from the closure body and inserted into the closure body wherein a mechanical engagement holds the two compounds together. Embodiments of such designs are shown in FIGS. 25–29.

Figure 25:
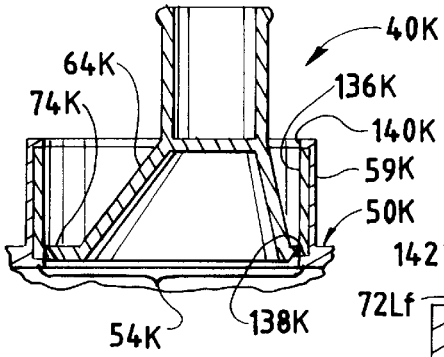
FIG. 25 is a fragmentary, cross-sectional view of a twelfth embodiment of the closure of the present invention.

In particular, FIG. 25 illustrates a twelfth embodiment of a closure of the present invention designated generally therein by the reference number 40K. The closure 40K includes a closure body 50K containing a tamper-evident seal 54K. The body 50K has a dispensing spout 59K, and the seal 54K includes a projection 64K connected with a frangible web 74K to an annular wall 136K which is concentrically disposed within the spout 59K. The body 50K defines a shoulder 138K on which the bottom of the annular wall 136K rests. The spout 59K includes an inwardly directed flange 140K at the top end of the seal annular wall 136K.

The seal 54K is separately molded from the body 50K, and the seal 54K is then inserted into the body 50K and held therein with a snap-fit engagement.

Figure 26:
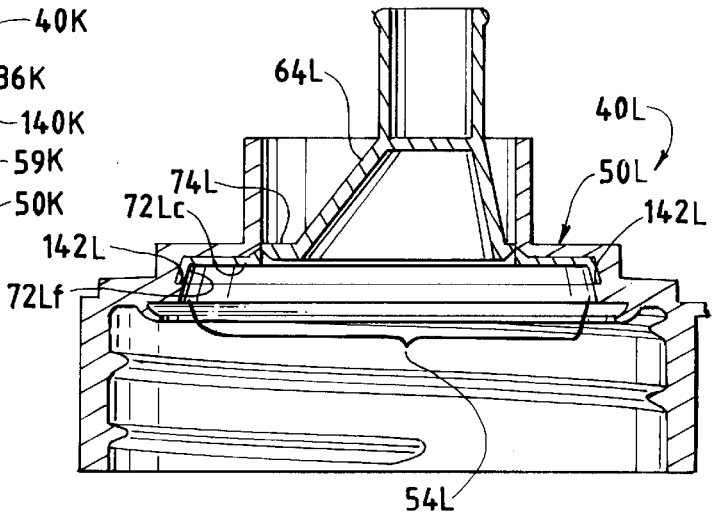
FIG. 26 is a fragmentary, cross-sectional view of a thirteenth embodiment of the closure of the present invention.

FIG. 26 illustrates a thirteenth embodiment of the closure designated generally by the reference number 40L. The closure 40L includes a tamper-evident insert 54L. The seal 54L includes a projection 64L connected with a frangible web 74L to a peripheral anchor portion 74L*c*. Angled flange 72L*f* extends from the outer edge of the anchor portion 72L*c*.

The closure 40L includes a body 50L which is substantially similar to the body 50E of the sixth embodiment illustrated in FIG. 19. However, the thirteenth embodiment body 50L includes an annular shoulder 142L for retaining the seal 54L in a snap-fit engagement within the body 50L.

In the embodiments illustrated in FIGS. 25 and 26, wherein the seal 54K or 54L is separately molded and subsequently inserted into a previously fabricated closure body, a liquid-tight or gas-tight seal need not necessarily be provided between the contacting surfaces of the seal and the closure body if the application does not require that. If the seal, such as 54K in FIG. 25 or seal 54L in FIG. 26, does not provide a seal against liquid or vapor, it would nevertheless function as an entrance seal of the tamper-evident type wherein normal access to the container can only be gained by tearing away the seal. Thus, when the term "seal" is used herein, and in the claims, to designate a tamper-evident structure which occludes the dispensing orifice, it should be understood that the term "seal" nevertheless includes structures that do not necessarily provide a liquid-tight or gas-tight seal of the dispensing orifice.

Figure 27:
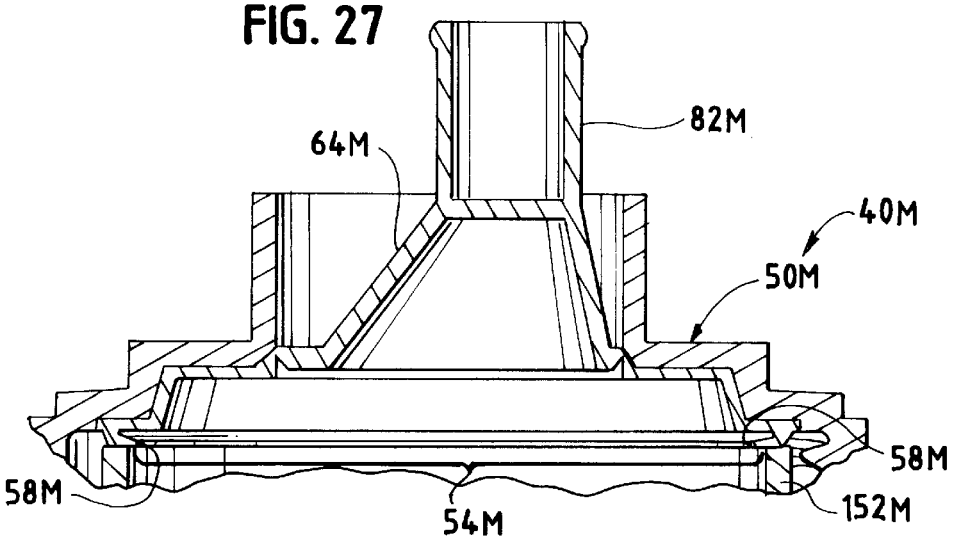
FIG. 27 is a fragmentary, cross-sectional view of a fourteenth embodiment of the closure of the present invention.

FIG. 27 illustrates a fourteenth embodiment of the closure of the present invention designated generally therein by the reference number 40M. The closure 40M includes a body 50M and a tamper-evident seal 54M. The seal 54M includes a projection 64M and an upper tubular member 82M. The structure of the fourteenth embodiment of the closure 40M is similar to the structure of the first embodiment of the closure 40 described above with reference to FIGS. 1–5. However, the fourteenth embodiment of the closure 40M has a taller tubular member 82M and is fabricated in a different manner. In particular, the first embodiment of the closure 40 illustrated in FIGS. 1–5 is preferably molded in a multi-shot injection molding process, and the seal 54 preferably attached to the closure base body by the creation of a weld defined by the interface solidification of melted portions of the first material employed for molding the body and of the second material employed for molding the seal. In contrast, the fourteenth embodiment of the closure 40M does not employ a multi-shot injection molding process. Rather, the closure body 50M and the seal 54M are each separately molded in a conventional manner. Subsequently, the seal 54M is inserted into the closure body 50M. The two components are retained together by suitable means such as an interference fit, a snap-fit engagement, adhesive, etc.

FIG. 27 shows the top edge of the neck 152M of a container on which the closure 40M is mounted. The insert 54M includes a crab's claw type annular container neck seal 58M, and the seal 58M is deformed upwardly owing to its sealing engagement with the upper end surface of the container neck 152M.

Figure 28:
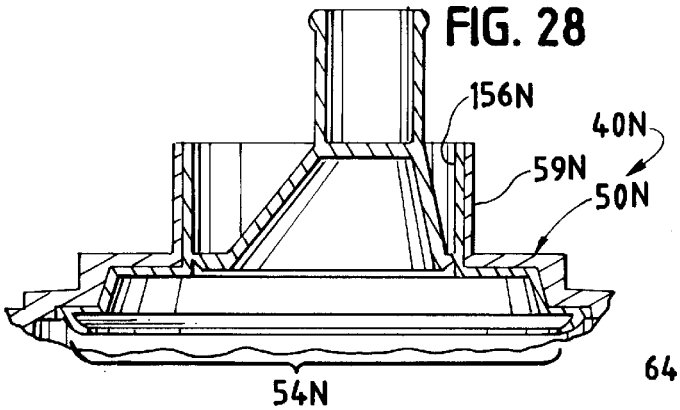
FIG. 28 is a fragmentary, cross-sectional view of a fifteenth embodiment of the closure of the present invention.

FIG. 28 illustrates a fifteenth embodiment of the closure of the present invention designated generally therein by the reference number 40N. The closure 40N includes a body 50N and an inserted seal 54N which is substantially similar to the seal 54M described above with reference to the fourteenth embodiment illustrated in FIG. 27. However, in the fifteenth embodiment of the closure 40N, the inserted seal 54N also includes an upwardly projecting, annular wall 156N which is concentric with, and disposed adjacent, the interior surface of a spout 59N defined by the closure body 50N. The body 50N and seal 54N are molded separately, and then the seal 54N is inserted into the closure body 50N and retained therein by suitable means, such as adhesive, friction fit, etc.

Figure 29:
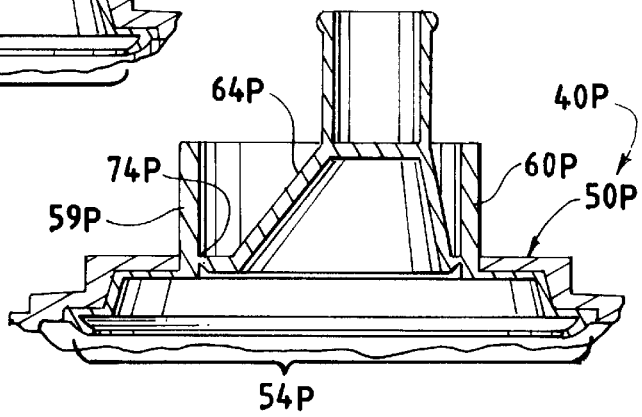
FIG. 29 is a fragmentary, cross-sectional view of a sixteenth embodiment of the closure of the present invention.

A sixteenth embodiment of the closure of the present invention is illustrated in FIG. 29 wherein the closure is designated generally by the reference number 40P. The closure 40P has a body 50P and a tamper-evident seal 54P.

The closure body 50P does not include a unitary spout. Instead, the top deck of the body 50P defines a dispensing orifice 60P for receiving a dispensing spout 59P which is defined by an extension of the seal 54P. The seal 54P includes a central portion, such as a projection 64P within the spout 59P, and the projection 64P is connected in a unitary manner with the surrounding spout 59P by means of a frangible web 74P. The seal 54P is separately molded from the body 50P and then inserted into the body 50P. The two components are retained together by suitable means, such as with an interference fit, snap-fit, adhesive, etc.

In the embodiments discussed above with reference to FIGS. 25–29 wherein the tamper-evident seal and body are separately molded and wherein the seal is then inserted into the body, the inserted seal is preferably molded from a different material than is used for the closure body. If the inserted tamper-evident seal is used in those applications where (1) liquid or gas leak-tightness is not required, and (2) the seal functions solely as a tamper-evident seal, then the material used for the seal should preferably still have physical characteristics that accommodate proper attachment of the seal to the closure body and that accommodate the desired tearing away of the central portion of the seal.

However, in those embodiments wherein the tamper-evident seal is intended to also provide a liquid-tight and/or gas-tight seal, then the material used for the tamper-evident seal should also include appropriate sealing properties and barrier properties as may be necessary for the specific application in which the closure is used. Further, those tamper-evident seals which are also intended to provide liquid-tight sealing and/or gas-tight sealing may be preferably molded from materials that accommodate the formation of container neck sealing systems, such as the crab's claw seal (seal 58 in FIG. 2), the plug seal (54H in FIG. 22), the V-shaped seal (130I in FIG.23), and the flat seal (132J in FIG. 24).

Figure 30:
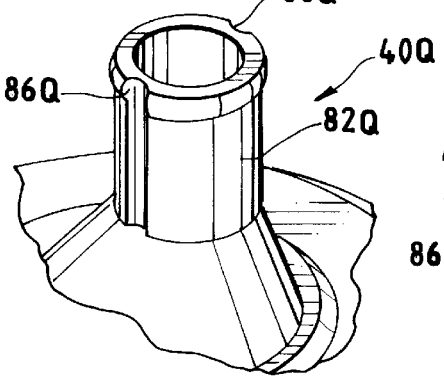
FIG. 30 is a fragmentary, cross-sectional view of a seventeenth embodiment of the closure of the present invention.

With reference to the first embodiment of the closure 40 described above and illustrated in FIGS. 1–5, it will be appreciated that the various designs may be provided for the tubular member 82 which is grasped by the user. For example, the grooves 86 (FIG. 1) which accommodate flattening of the member 82 (as shown in FIG. 5) may have alternate configurations. FIG. 30 illustrates a seventeenth embodiment of a closure 40Q in which a tubular member 82Q includes a pair of vertical grooves 86Q. The grooves 86Q are not V-shaped as in the first embodiment illustrated in FIG. 1. Rather, the grooves 86Q each have a semi-circular cross-section so as to define a generally semi-cylindrical shaped groove.

Figure 31:
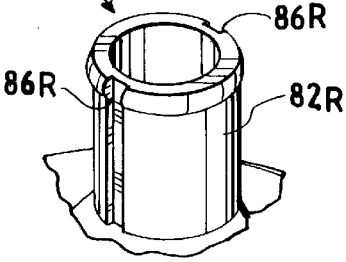
FIG. 31 is a fragmentary, cross-sectional view of an eighteenth embodiment of the closure of the present invention.

FIG. 31 illustrates an eighteenth embodiment of a closure 40R having a tubular member 82R with grooves 86R which are each defined by a pair of opposed planar sidewalls connected by a planar crosswall. This may be characterized as defining a generally rectangular cross-section groove.

Figure 32:
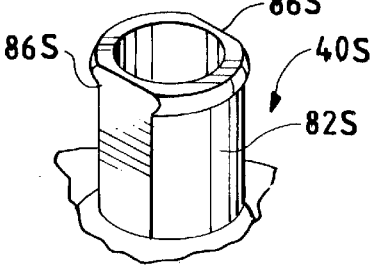
FIG. 32 is a fragmentary, cross-sectional view of a nineteenth embodiment of the closure of the present invention.

A nineteenth embodiment of a closure is illustrated in FIG. 32 and is designated generally therein by the reference number 40S. The closure 40S includes a tubular member 82S with two oppositely facing flat surfaces 86S. The flat surfaces 86S do not define grooves per se. However, each flat surface 86S defines a reduced thickness section of the wall of the tubular member 82S, and this permits the tubular member 82S to be readily squeezed together and flattened when it is grasped.

Figure 33:
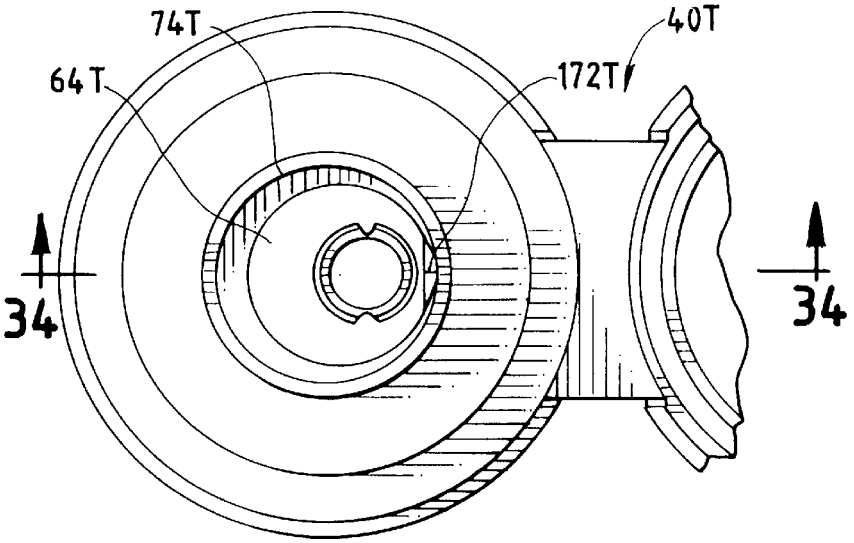
FIG. 33 is a fragmentary, cross-sectional view of a twentieth embodiment of the closure of the present invention.
Figure 34:
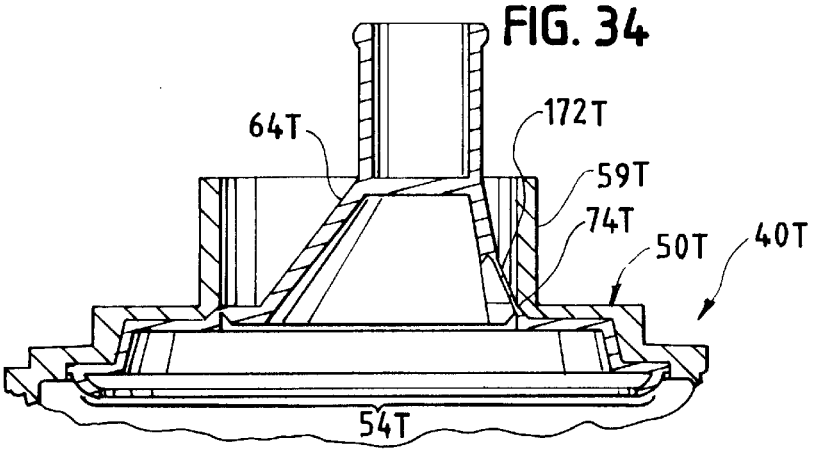
FIG. 34 is a fragmentary, cross-sectional view taken generally along the plane 34—34 in FIG. 33.
Figure 35:
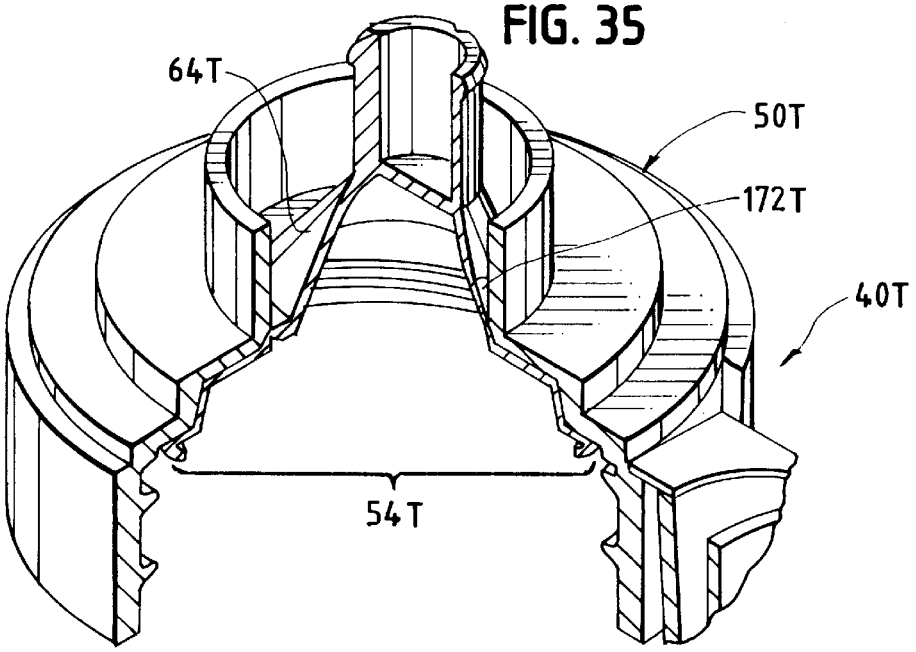
FIG. 35 is a fragmentary, perspective view of the twentieth embodiment of the closure illustrated in FIGS. 33 and 34, but FIG. 35 shows a portion of the closure cut away to illustrate interior details.

FIGS. 33, 34, and 35 illustrate a twentieth embodiment of the closure designated generally by the reference number 40T. As shown in FIG. 34, the closure 40T includes a body 50T and seal 54T. The insert seal 54T includes a projection 64T extending upwardly into a spout 59T defined by the closure body 50T. The projection 64T includes a V-shaped exterior region 172T (FIG. 33). As shown in FIGS. 34 and 35, the wall thickness of the projection 64T is drastically reduced on the interior, with the thinnest portion of the wall located adjacent the base of the projection 64T and connected to a frangible web 74T which circumscribes the central portion of the seal 54T adjacent the inside vertical surface of the body spout 59T. The V-shaped region 172T decreases the strength of the structure at that location so that the frangible web 74T begins tearing at that location when pulling forces are applied to the projection 64T.

Figure 36:
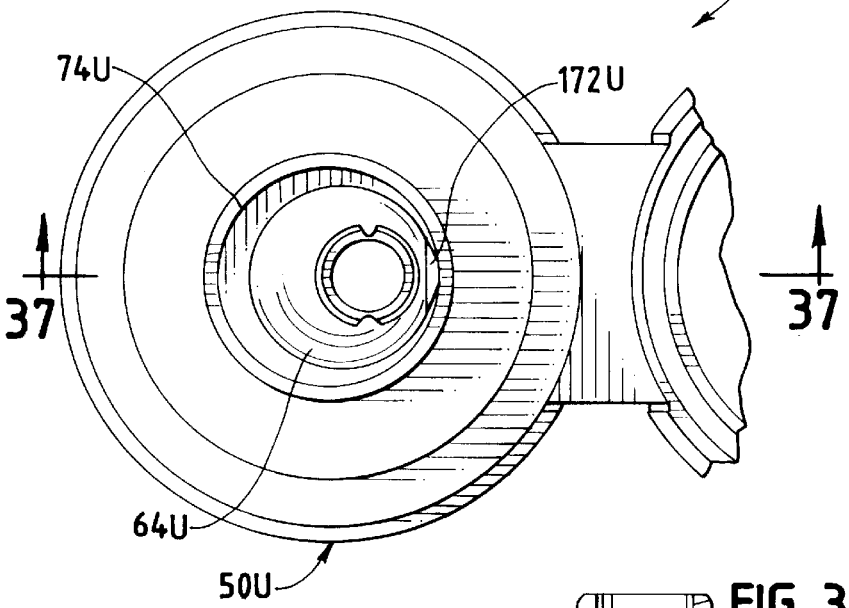
FIG. 36 is a fragmentary, plan view of a twenty-first embodiment of the closure of the present invention.
Figure 37:
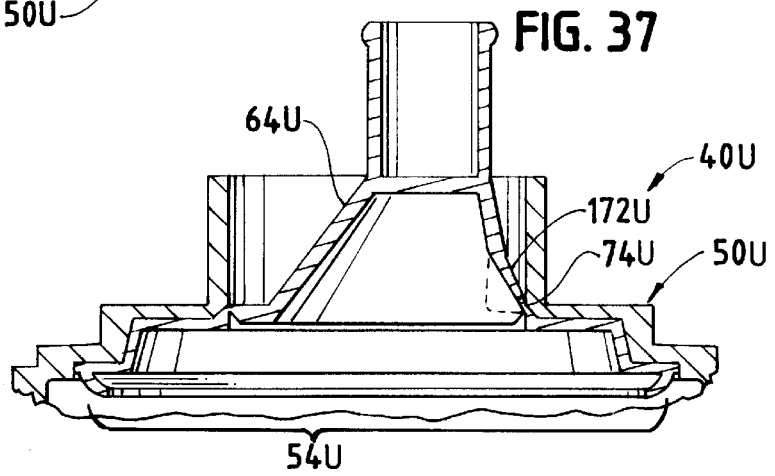
FIG. 37 is a fragmentary, cross-sectional view taken generally along the plane 36—36 in FIG. 37.
Figure 38:
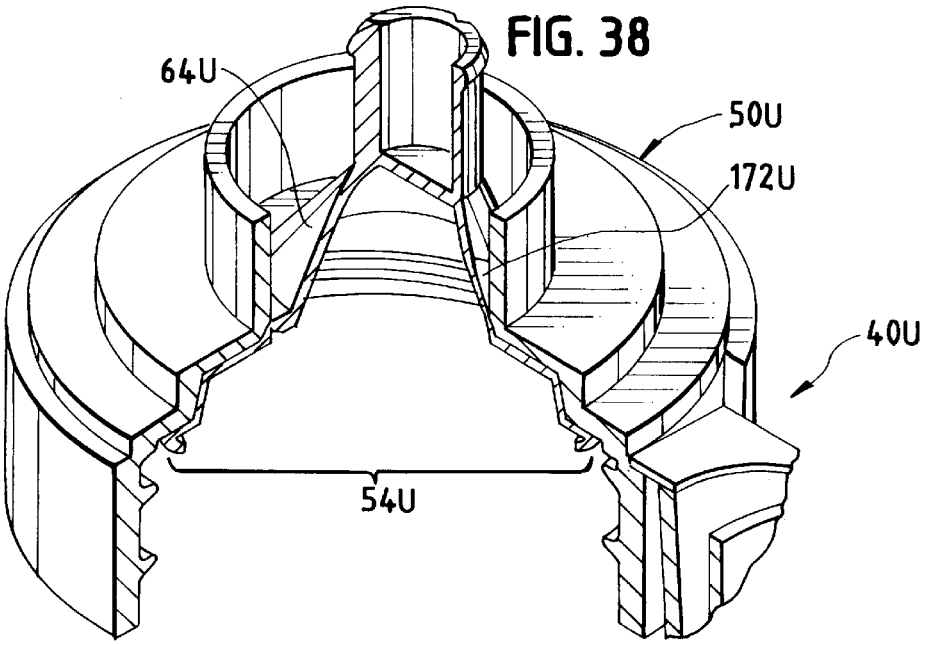
FIG. 38 is a fragmentary, perspective view of the twenty-first embodiment of the closure of the present invention illustrated in FIGS. 36 and 37, but FIG. 38 shows a portion of the closure cut away to illustrate interior details.

FIGS. 36–38 illustrate a twenty-first embodiment of the closure of the present invention designated generally therein by the reference number 40U. The twenty-first embodiment of the closure 40U is substantially identical to the twentieth embodiment of the closure 40T discussed above with reference to FIGS. 33–35 except that the twenty-first embodiment of the closure 40U has a seal projection 64U with a concave region 172U instead of the V-shaped region 172T. The concave region 172U defines a reduced thickness section of the projection wall. When a pulling force is applied to the projection 64U, the central portion of the seal 54U is torn away. The tear begins at the bottom end of the concave region 172U where the concave region intersects a circular frangible web 74U which circumscribes the central portion of the seal 54U.

Finally, FIGS. 39–42 illustrate a twenty-second embodiment of the present invention designated generally therein by the reference number 40V. The closure 40V includes a body 50V and a tamper-evident seal 54V. The seal 54V includes a central portion having a projection 64V and an upwardly extending tubular member 82V. The body 50V includes a surrounding spout 59V. For ease of illustration, the spout 59V has been broken away in FIGS. 41 and 42.

The tamper-evident seal 54V includes a peripheral anchor portion 72V*c* attached to the closure body 50V. The anchor portion 72V*c* in connected via a first frangible web 74V to a central portion comprising a flat region 62V and a projection 64V from which a tubular member 82V extends. The first frangible web 74V is defined by a circular groove 75V in a closed tear path lying in a plane around the central portion of the seal 54V.

Figure 39:
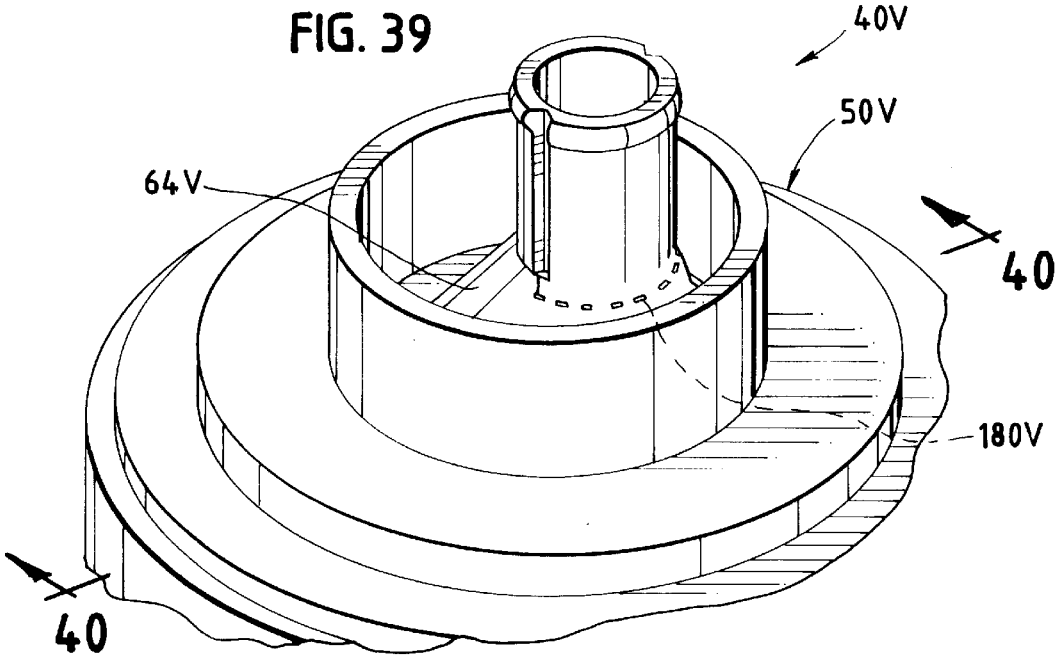
FIG. 39 is a fragmentary, perspective view of a twenty-second embodiment of the closure of the present invention.
Figure 40:
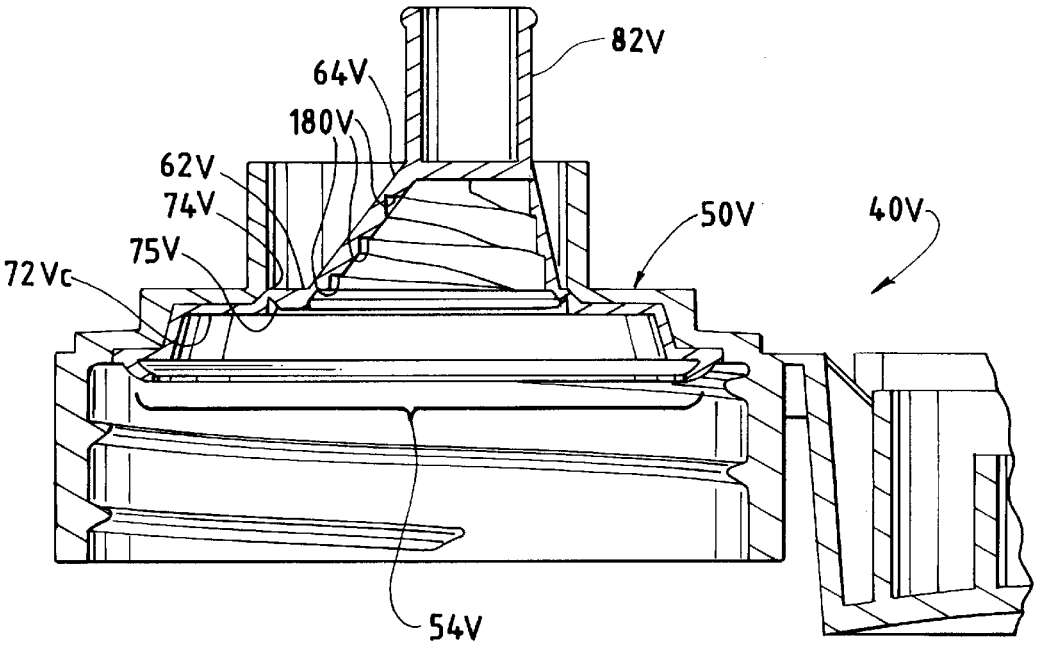
FIG. 40 is a fragmentary, cross-sectional view taken generally along the plane 40—40 in FIG. 39.
Figure 41:
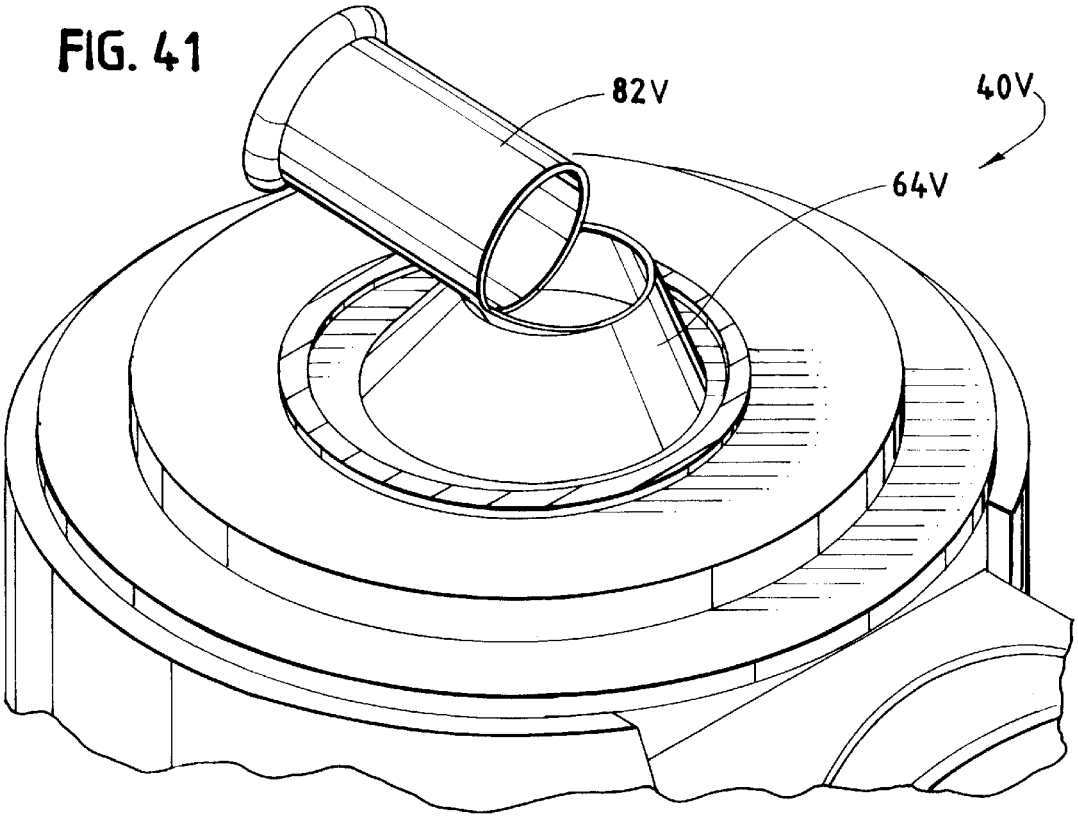
FIG. 41 is a view similar to FIG. 39, but FIG. 41 shows the twenty-second embodiment of the closure with the spout cut away to show the interior tear configuration after the seal has been partially torn.

A second frangible web is defined on the inside of the projection 64V by a helical shoulder or groove 180V as shown in FIG. 40. The upper end of the groove 180V starts adjacent the top of the projection 64V (the groove 180V on the inside of the projection 64V being illustrated in FIG. 39 by the dashed lines). The bottom end of the groove 180V merges with the groove 75V defining the first frangible web 74V at the point where the base is coincident with the first frangible web 74V.

Figure 42:
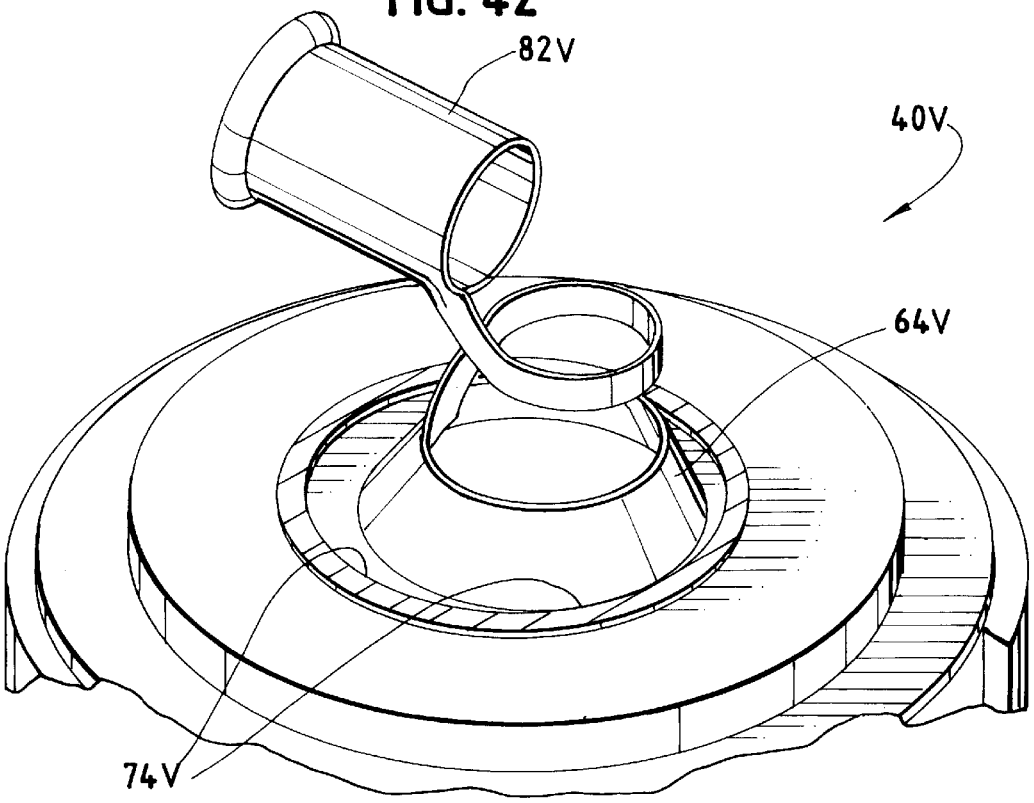
FIG. 42 is a view similar to FIG. 41, but FIG. 42 shows the tear configuration after the seal has been torn more than in FIG. 41.

When it is desired to open seal 54V by tearing the web 74V, the tubular member 82V can be grasped and pulled (as illustrated in FIG. 39) so as to initiate a tear in the second frangible web 180V at the top of the projection 64V. As shown in FIG. 42, the user continues to pull on the tubular member 82V, and the tearing of the second frangible web progresses down the projection 64V to the first frangible web 74V which subsequently tears away. Preferably, the tearing of the second frangible web along the groove 180V at the top of the projection 64V is readily initiated by first pulling forwardly on the tubular member 82V so as to bend or tilt the member 82V forward.

The various embodiments of the closures illustrated in FIGS. 1–42 show a first frangible web (e.g., 74 in FIG. 2) which lies in a plane generally perpendicular to the longitudinal axis of the dispensing orifice. However, it will be appreciated that the first frangible web may lie in a plane oriented an oblique angle.

It will be appreciated that other modifications may be incorporated in the closure design. For example, portion of the seal (such as the seal central portions 62 and 64 in the first embodiment illustrated in FIGS. 1 and 2) may be provided at a different elevations within the closure body. The central portions 62 and 64 and may be located further up the spout 59, or even below the spout. For example, if the seal structure includes an annular wall such as the wall 156N in the embodiment shown in FIG. 28, then the central portions of the seal 54N could be located even at the top of the wall 156N adjacent the distal end of the spout 59N.

In another embodiment, the spout may be so short as to be defined essentially by just the thickness of the body deck (e.g., annular shoulder 57C in FIG. 2).

The closure of this invention readily accommodates fabrication of the closure tamper-evident seal from a material different from the closure body material. This permits optimization of the body material and seal material to better accommodate their different functions.

It will be readily observed from the foregoing detailed description of the invention and from the illustrations thereof that numerous other variations and modifications may be effected without departing from the true spirit and scope of the novel concepts or principles of this invention.

What is claimed is:

1. A closure for an opening to a container interior, said closure comprising:

a body for mounting to said container around said opening, said body defining a dispensing orifice for communicating with said container opening; and a seal having a removable central portion occluding said orifice and at least a first frangible web defining a closed tear path lying in a plane connecting said seal central portion to a surrounding part of said closure, said seal central portion including a hollow projection having a base located in said plane with one part of the base closer to said first frangible web than is any other part of said base whereby a tension force of sufficient magnitude applied to said projection will produce a tear which extends through said first frangible web at a point on said first frangible web closest to said one part of said projection base and which thereafter propagates from said point around said seal central portion so as to separate said seal central portion from said closure and thereby open said seal.

2. The closure in accordance with claim 1 in which said hollow projection is a frustum of a cone.

3. The closure in accordance with claim 1 in the surrounding part of said closure to which said seal central portion is connected includes a peripheral anchor portion of said seal that is attached to said body and that is connected via said first frangible web to said central portion of said seal.

4. The closure in accordance with claim 1 in which said first frangible web is a reduced thickness section of material.

5. The closure in accordance with claim 1 in which said body is injection molded only from a first material; and said seal is subsequently injection molded only from a second material.

6. The closure in accordance with claim 1 in which said hollow projection is a frustum of a cone;

said projection base is a circular base defined by said frustum;

said frustum has a circular upper end;

said body includes an annular spout defining said orifice with a circular configuration having a longitudinal axis; and said frustum circular base has a perpendicular axis that is parallel to, but offset from, said orifice longitudinal axis.

7. The closure in accordance with claim 6 in which said frustum circular upper end has a perpendicular axis that is parallel to, but offset from, said frustum base axis.

8. The closure in accordance with claim 1 in which said first frangible web lies in a circle adjacent the periphery of said orifice;

said projection base is circular;

said one part of said base is generally tangent to said first frangible web; and the remaining part of said projection base lies within said circular first frangible web.

9. The closure in accordance with claim 1 in which said projection is collapsible.

10. The closure in accordance with claim 9 in which said projection has a frustoconical shape; and said projection has at least one groove defining a reduced cross sectional thickness region acting as a hinge to accommodate collapse of said projection.

11. The closure in accordance with claim 10 in which said projection has a plurality of grooves lying in parallel planes.

12. The closure in accordance with claim 10 in which said projection has a plurality of parabolic grooves.

13. The closure in accordance with claim 10 in which said groove has a helical configuration.

14. The closure in accordance with claim 1 in which said seal includes a peripheral anchor portion that is connected with, and located radially outwardly of, said first frangible web and that is sealingly connected with said body around said orifice.

15. The closure in accordance with claim 1 in which said projection is a frustum of a cone having a circular upper end;

said seal further includes a squeezable, hollow, tubular grasping member extending upwardly from said circular upper end whereby said grasping member can be grasped to exert a force on said projection.

16. The closure in accordance with claim 15 in which said grasping member defines two, vertical, exterior grooves.

17. The closure in accordance with claim 1 in which said seal and body are molded as a unitary structure from one material; and said first frangible web is located adjacent the periphery of said orifice.

18. The closure in accordance with claim 1 in which said first frangible web lies in a circle adjacent the periphery of said orifice;

said projection includes a hollow frustum with a circular upper end;

said projection includes a hollow, cylindrical wall extending from said circular upper end of said projection;

said projection base is circular;

said one part of said base is generally tangent to said circular first frangible web, and the remaining part of said projection base lies radially inwardly of said circular first frangible web; and a second frangible web is defined in said frustum, said second frangible web lying in a helical path beginning at one end adjacent said projection upper end and merging at its other end with said first frangible web at said point on said first frangible web which is tangent to said projection base.

19. A closure for an opening to a container interior, said closure comprising:

a body for mounting to said container around said opening, said body defining a dispensing orifice for communicating with said container opening; and a tamper-evident seal extending across said dispensing orifice, said seal including;

(a) a peripheral anchor portion sealingly connected with said body around said orifice, (b) a removable central portion, (c) at least a first, frangible, closed path connecting web lying in a plane and located adjacent the periphery of said orifice to connect said seal central portion with said seal peripheral anchor portion, and (d) said seal central portion including a hollow projection having a base located with one part of the base closer to said frangible closed path connecting web than is any other part of said base whereby a tension force of sufficient magnitude applied to said projection will produce a tear which extends through said web at a point on said web closest to said one part of said projection base and which thereafter propagates from said point around said seal central portion so as to separate said seal central portion from said seal anchor portion and thereby open said seal.

20. A closure in accordance with claim 19 in further including a lid for occluding said dispensing orifice in a closed position and for being moved away from said closed position to permit dispensing of container-stored contents out of said orifice.

* * * * *